US011231167B2

(12) United States Patent
Jeswani et al.

(10) Patent No.: US 11,231,167 B2
(45) Date of Patent: Jan. 25, 2022

(54) DOWNLIGHT HAVING QUICK CONNECT DRIVER ASSEMBLY AND TEST MODULE

(71) Applicants: Anil Jeswani, Acton, MA (US); Renaud Richard, Manchester, NH (US); Ahmed Eissa, Cambridge, MA (US); Valeriy Zolotykh, Boston, MA (US)

(72) Inventors: Anil Jeswani, Acton, MA (US); Renaud Richard, Manchester, NH (US); Ahmed Eissa, Cambridge, MA (US); Valeriy Zolotykh, Boston, MA (US)

(73) Assignee: LEDVANCE LLC, Wilmington, MA (US)

( * ) Notice: Subject to any disclaimer, the term of this patent is extended or adjusted under 35 U.S.C. 154(b) by 1 day.

(21) Appl. No.: 16/846,483

(22) Filed: Apr. 13, 2020

(65) Prior Publication Data

US 2021/0317977 A1 Oct. 14, 2021

(51) Int. Cl.

| | |
|---|---|
| ***F21V 23/06*** | (2006.01) |
| ***F21V 23/00*** | (2015.01) |
| ***F21V 23/04*** | (2006.01) |
| ***F21S 8/02*** | (2006.01) |
| *F21V 29/76* | (2015.01) |
| *F21Y 115/10* | (2016.01) |
| *F21Y 105/18* | (2016.01) |

(52) U.S. Cl.

CPC ..... *F21V 23/06* (2013.01); *F21S 8/026* (2013.01); *F21V 23/003* (2013.01); *F21V 23/0435* (2013.01); *F21V 29/76* (2015.01); *F21Y 2105/18* (2016.08); *F21Y 2115/10* (2016.08)

(58) Field of Classification Search

CPC .... F21V 23/06; F21V 23/003; F21V 23/0435; F21S 8/026; F21S 9/02

See application file for complete search history.

(56) References Cited

U.S. PATENT DOCUMENTS

2013/0200707 A1* 8/2013 Hartmann ..... H02J 9/02 307/39
2014/0254177 A1* 9/2014 Danesh ..... F21S 8/026 362/363
2017/0311399 A1* 10/2017 Shah ..... F21V 23/009

* cited by examiner

*Primary Examiner* — Karabi Guharay
(74) *Attorney, Agent, or Firm* — Tutunjian & Bitetto PC

(57) ABSTRACT

A lighting test method that includes connecting a housing including driver electronics and a junction box to a main power source. The main power source is connected to a main power connector in the junction box. The driver electronics includes a first terminal. The method further includes connecting a power testing module to the first terminal to the driver electronics to determine whether the main power source is correctly connected to the main power connector in the junction box. The method further includes replacing the power testing module with a second terminal of a light engine housing. Connecting the first and second terminals provides that the driver electronics are in electrical communication with a light engine within the light engine housing.

7 Claims, 20 Drawing Sheets

DOWNLIGHT HAVING QUICK CONNECT DRIVER ASSEMBLY AND TEST MODULE

TECHNICAL FIELD

The present disclosure generally relates to lamp assemblies employing light emitting diodes as the light source, and lighting installation methods.

BACKGROUND

One of the most common light fixtures for residential or commercial applications is the recessed can downlight (RCD), which is an open-bottom can that contains a light bulb, most commonly an incandescent bulb or a fluorescent bulb. The fixture is typically connected to the power mains at 120 to 277 volts, 50/60 Hz. The fixture can also be powered by a voltage of 347V. RCDs are generally installed during the construction of a building before the ceiling material (such as plaster or gypsum board) is applied. The ceiling is often left open for the wiring inspection. To verify functionality and the power connection to the light fixture, the whole reflector part of the downlight is therefore dangling from the ceiling. For large size downlights, that can be unsafe. Also, as larger downlights are bulky and heavy it may potentially damage the wiring due the stress on them from the dangling downlights from the ceiling.

SUMMARY

In one aspect, a method of installing a lighting structure is provided. The methods described herein employ a lighting structure that includes a driver electronics housing and a physically separate light engine housing, wherein electrical connection between the driver electronics housing and the light engine housing is through reversible driver to light source connector. The driver electronics housing includes a main power connection. The connection of the main power line to the main power connection can be tested through a test module that is engaged to the terminal of the reversible driver to light source connector that is in electrical communication with the driver electronics of the driver electronics housing.

In one embodiment, a lighting test method is provided that includes connecting a housing including driver electronics and a junction box to a main power source. The main power source is connected to a main power connector in the junction box. The driver electronics includes a first terminal. The method further includes connecting a power testing module to the first terminal to the driver electronics to determine whether the main power source is correctly connected to the main power connector in the junction box. The method further includes replacing the power testing module with a second terminal of a light engine housing. Connecting the first and second terminals provides that the driver electronics are in electrical communication with a light engine within the light engine housing.

In another embodiment, a lighting test method is provided that includes connecting a two-level housing having a vertical stack of a driver electronics level and junction box level to a main power source. The main power source is connected to a main power connector in the junction box level, and the driver electronics level includes a first terminal. A power testing module is connected to the first terminal to the second housing to determine whether the main power source is correctly connected to the main power source. The method further includes replacing the power testing module with a second terminal of a light engine housing, in which the first and second terminal electrically are connected to provide that the driver electronics are in electrical communication with a light engine within the light engine housing.

In yet another embodiment, a lighting test method is provided that includes connecting a driver electronics housing to a main power source, in which the driver electronics housing includes two laterally disposed compartments for electrical connections on opposing sides of a centrally positioned compartment including driver electronics. The driver electronics are in communication with a switch for setting lighting characteristics present on an exterior of the driver electronics housing. The driver electronics are present in electrical communication with a first terminal extending to the exterior of the driver electronics housing, wherein a first compartment of the two laterally disposed compartments includes a main power connector for connection to the main power source. The method further includes connecting a power testing module to the first terminal to determine whether the main power source is correctly connected to the main power source. The power testing module may then be replaced with a second terminal of a light engine housing. The first and second terminals are electrically connected to provide that the driver electronics are in electrical communication with a light engine within the light engine housing.

BRIEF DESCRIPTION OF THE DRAWINGS

The following description will provide details of embodiments with reference to the following figures wherein.

DETAILED DESCRIPTION

Figure 2:
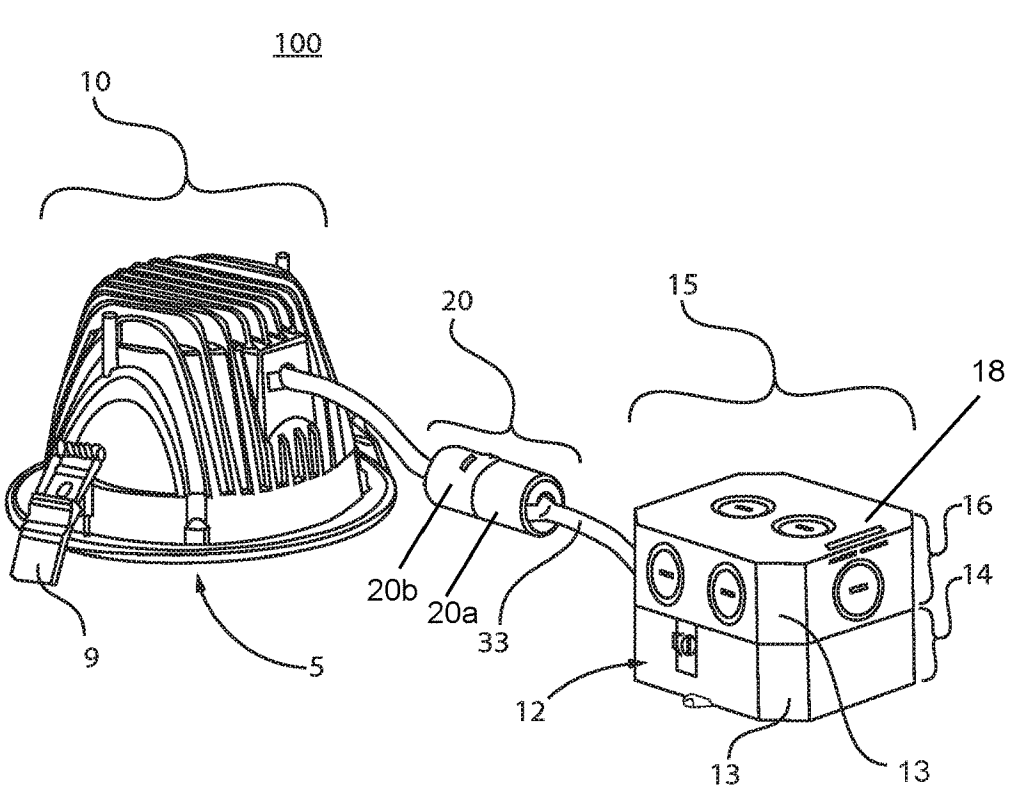
FIG. 2 is another perspective view of the downlight depicted in FIG. 1.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

In some embodiments, the present disclosure provides a method of installing a lighting structures. The methods described herein employ a lighting structure that includes a driver electronics housing and a physically separate light engine housing, wherein electrical connection between the driver electronics housing and the light engine housing is through reversible driver to light source connector. The driver electronics housing includes a main power connection. The connection of the main power line to the main power connection can be tested through a test module that is engaged to the terminal of the reversible driver to light source connector that is in electrical communication with the driver electronics of the driver electronics housing.

The lighting structures of the present disclosure may include a downlight with selectable light characteristic settings, in which the settings can be selected by switches that are fixed to a housing containing the driver electronics for the downlight, in which the housing containing the driver electronics is physically separate from the housing containing the light source, e.g., light emitting diode (LED) light source for the downlight.

In some embodiments, the lighting structures provided by the structures and methods of the present disclosure may be employed in retrofit applications or new construction applications. In some embodiments, the methods and structures of the present disclosure provide a driver box (hereafter referred to a housing for driver electronics) that is separable from the reflector part of the lighting fixture so that it can be easily retrofitted in place for retrofit installation, or mounted to a new tray for installation in a new construction application. In lighting fixtures designs prior to the present disclosure, the housing for the driver electronics are generally integrated into the same housing that houses the reflector/light engine. In some instances, in which the driver electronics are not separated from the housing for the reflector/light engine, installation requires both structures, i.e., light engine housing and driver electronics, be installed at once. To install these prior designs, the installer must remove the tile/ceiling portion at which the light fixture will be installed.

In the lighting structures and methods of the present disclosure, the light engine/reflector portion of the fixture is present in a housing (light engine housing) that is separate from the housing (driver electronics housing) that contains the driver electronics, in which the two physically separate housings are electrically connected through a wired connection including a reversible connector. The reversible connector allows for the driver electronics and the light engine to be installed into the lighting location separately. This can provide for versatility between new construction and retrofit applications in a single product.

Further, the methods and structures of the present disclosure also include a light test module that can be engaged to a terminal of the reversible connector that is in electrical communication with the driver electronics for the light structure. The light test module can indicate that a proper connection of the light structure is made to the main power source, or indicate that the light structure is not property connected to the main power source. This can increase the ease of light structure installation.

The downlight structures of the present disclosure are now described with greater detail with reference to FIGS. 1-21. In one embodiment, a lighting test method is provided that includes connecting a housing including driver electronics and a junction box (referred to as a driver electronics housing 15, 15*a*) to a main power source (e.g., main power line 30). The main power source is connected to a main power connector in the junction box (compartment of the driver electronics housing 15, 15*a*). The driver electronics includes a first terminal 20*a*. The method further includes connecting a power testing module 60 to the first terminal 20*a* to the driver electronics to determine whether the main power source 30 is correctly connected to the main power connector in the junction box. The method further includes replacing the power testing module 60 with a second terminal 20*b* of a light engine housing 10. Connecting the first and second terminals 20*a*, 20*b* provides that the driver electronics are in electrical communication with a light engine within the light engine housing 10.

FIGS. 1-3, 10, 12, 13 and 14 depict one embodiment of a downlight 100 including a light engine having a plurality of solid state light emitters, e.g., light emitting diodes (LEDs) 50 that can be used in the light installation and test methods of the present disclosure. A "downlight", or recessed light, (also pot light in Canadian English, sometimes can light in American English) is a light fixture that is installed into a hollow opening in a ceiling. When installed it appears to have light shining from a hole in the ceiling, concentrating the light in a downward direction as a broad floodlight or narrow spotlight. "Pot light" or "canister light" implies the hole is circular and the lighting fixture is cylindrical, like a pot or canister.

Broadly, the lamp of the present disclosure is a downlight fixture that includes: 1) a two-piece housing, 2) a reversible electrical connector connecting the two separate housings, 3) trim, and 4) a light engine. In some embodiments, the downlight 100 includes a light engine housing 10 having a recessed down lamp geometry for containing a light emitting diode (LED) light source; a driver electronics housing 15 for containing driver electronics including an exterior switch 12 for selecting lighting characteristics of light being projected by the light emitting diode (LED) light source; and a reversible driver to light source connector 20 for electrically connecting the light engine housing 10 containing the light emitting diode (LED) light source and the driver electronics housing 15 including the driver electronics.

Figure 1:
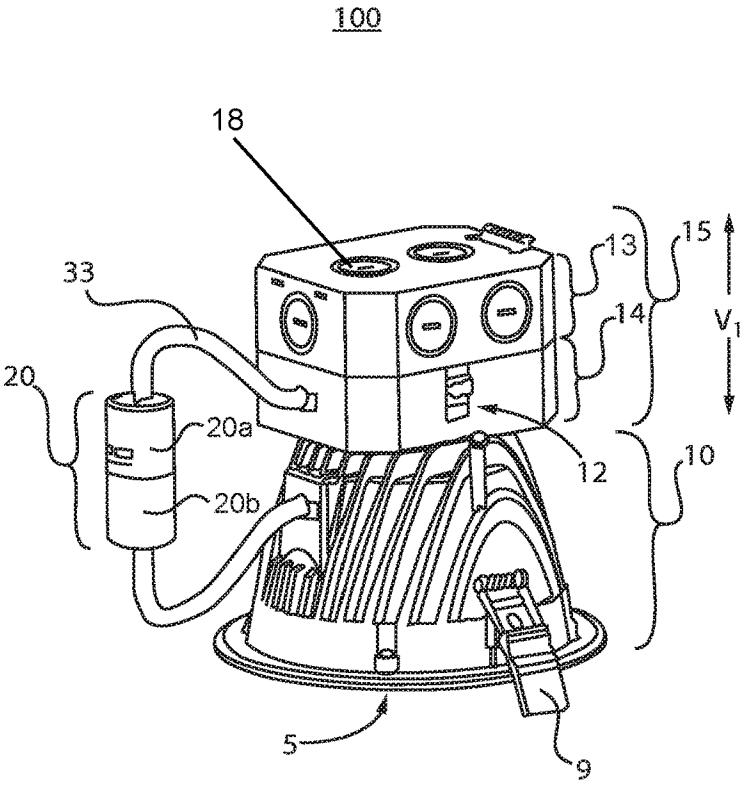
FIG. 1 is a perspective view of a downlight that includes a light engine housing having a recessed down lamp geometry, and a driver electronics housing including two levels in a vertical stack of a driver electronics level and junction box level, wherein the connection of the main power source to a main power connector in the junction box level is tested through a test module that can be engaged to a reversible driver to light source connector that is connecting the driver electronics in the driver electronics housing to the light engine within the light engine housing, in accordance with one embodiment of the present disclosure.
Figure 3:
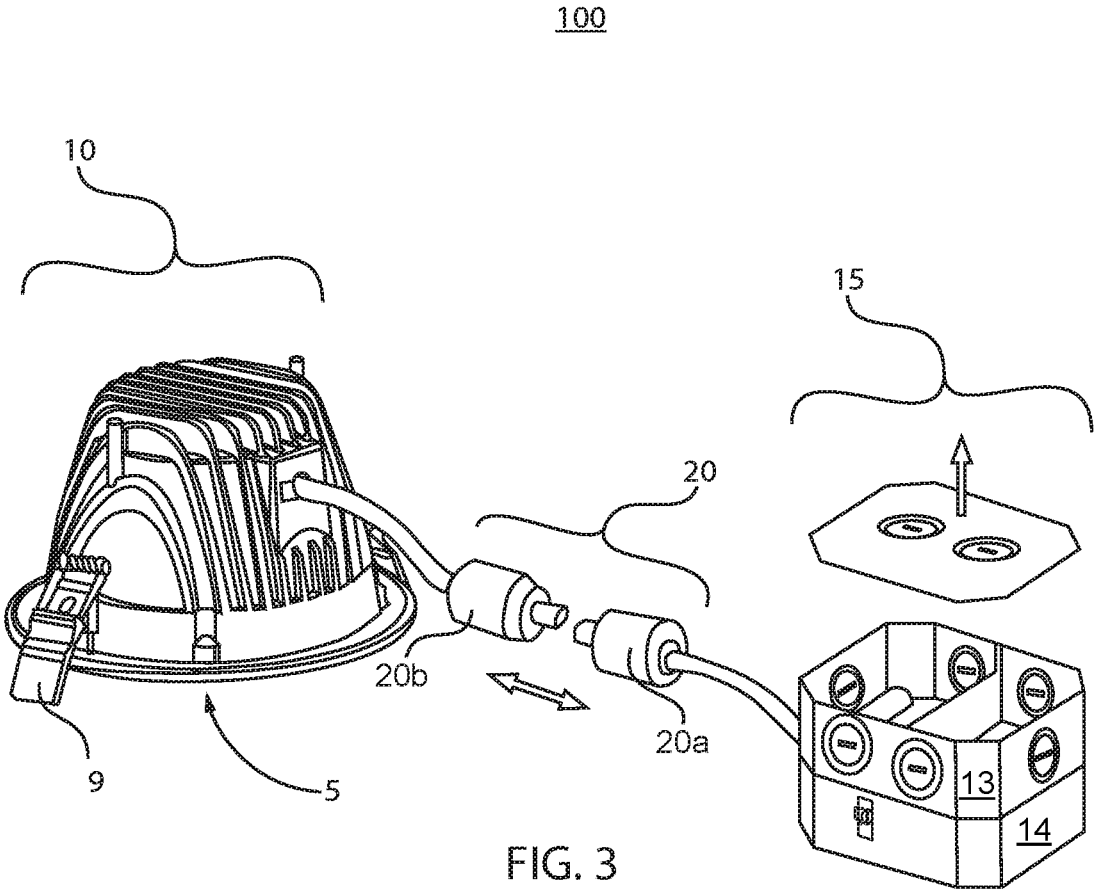
FIG. 3 is a perspective view of the downlight depicting in FIGS. 1 and 2, in which the cover removed from the junction box for the second housing including the driver electronics, and the connector being disconnected, in accordance with one embodiment of the present disclosure.

It is noted that this is not an exclusive list of the elements of a downlight fixture. The trim 5 is the visible portion of the downlight. The trim 5 is the insert that is seen when looking up into the fixture, and also includes the thin lining around the edge of the light. The light engine housing 10 is the portion of the fixture that includes the reflector and the light engine, and is installed inside the ceiling and contains the lamp holder. It is noted that embodiments are contemplated in which the trim 5 and the light engine housing 10 are integrated together in one piece, and there are embodiments in which the trim 5 and the light engine housing 10 are separate components. There are many different types of light engines that can be inserted into recessed lighting fixtures, i.e., downlights 100. In accordance with the embodiments of the present disclosure, the light engines applicable to the methods and structures described herein include solid state emitters, such as light emitting diodes (LEDs). The driver electronics housing 15 contains the driver electronics and including a switch 12 for selecting lighting characteristics of light mounted on an exterior wall of the driver electronics housing 15. In some embodiments, the driver electronics housing 15 that is depicted in FIGS. 1-3 includes two levels in a vertical stack of a driver electronics level 14 and junction box level 13. The connection of the main power source to a main power connector in the junction box level 13 is tested through a test module 60 that can be engaged to a reversible driver to light source connector 20 that is connecting the driver electronics in the driver electronics housing 15 to the light engine within the light engine housing 10.

The driver electronics housing 15 is vertically orientated to provide that the driver electronics are positioned in a driver electronics compartment 14 in a first level of the driver electronics housing 15 and a junction box 13 is present on a second level of the driver electronics housing 15 to provide that the main power connection from the power source to the junction box and a driver to light source power connection are vertically offset from one another.

Still referring to FIGS. 1-3, 10, 12, 13 and 14, the light fixtures of the present disclosure further include a reversible driver to light source connector 20 for electrically connecting the light engine housing 10 containing the light emitting diode (LED) light source and the driver electronics housing 15 including the driver electronics. The two piece housings, e.g., a light engine housing 10 including the light emitting diode (LED) light source, and a driver electronics housing 15 including the driver electronics/junction box, connected by the reversible driver to light source connector 20 allows for the two housings to be separated to allow for installation in both new construction or retrofit applications. The first terminal 20*a* of the reversible driver to light source connector 30 is in electrical communication with the driver electronics, and provides the connector that can be engaged by the light test module 60 for testing the main power connection to the main power connection within the junction box 13 of the driver electronics housing 15.

The light engine housing 10 that contains the light emitting diode (LED) light engine may be composed of a metal, such as aluminum (Al), which provides for heat dissipation of any heat produced by the light engine. In some embodiments, to provide for increased heat dissipation, a plurality of ridges or fin structures may be integrated into the aluminum housing, e.g., light engine housing 10. In some embodiments, the light engine housing 10 may also be composed of a plastic, such a polycarbonate. The construction of the light engine housing 10 may fall into one of four categories for downlights that are recognized in North America. For example, the housing may be constructed for IC or "insulation contact" rated new construction housings are attached to the ceiling supports before the ceiling surface is installed. If the area above the ceiling is accessible these fixtures may also be installed from within the attic space. IC housings are typically required wherever insulation will be in direct contact with the housing.

Non-IC rated new construction housings are used in the same situations as the IC rated new construction housings, only they require that there be no contact with insulation and at least 3 in (7.6 cm) spacing from insulation. These housings are typically rated up to 150 watts. IC rated remodel housings are used in existing ceilings where insulation will be present and in contact with the fixture. Non-IC rated remodel housings are used for existing ceilings where, no insulation is present. Non-IC rated remodel housings require that there be no contact with insulation and at least 3 in (7.6 cm) spacing from insulation. Sloped-ceiling housings are available for both insulated and non-insulated ceilings that are vaulted. It is noted that the light engine housing 10 of the downlight of the present disclosure may meet be designed to meet the requirements of any of the aforementioned standards. The light engine housing 10 is typically designed to ensure that no flammable materials come into contact with the hot lighting fixture.

The light engine housing 10 may be dimensioned to be available in various sizes based on the diameter of the circular opening where the downlight 100 is installed. In some examples, the circular opening of the light engine housing 10 may be sized in 6 and 8 inch diameter. It is noted that these dimensions are provided for illustrative purposes only and are not intended to limit the present disclosure. For example, the light engine housing 10 may also have a circular opening in diameters equal to 2 inches, 3 inches, 4 inches or 5 inches.

In some embodiments, the light engine housing 10 can also be "Air Tight", which means it will not allow air to escape into the ceiling or attic, thus reducing both heating and cooling costs.

The trim 5 of the downlight 100 is selected to increase the aesthetic appearance of the lamp. In some embodiments, the trim 5 may be a baffle that is black or white in color. In some embodiments, the trim 5 is made to absorb extra light and create a crisp architectural appearance. There are cone trims which produce a low-brightness aperture. In some embodiment, the trim 5 may be a multiplier that is designed to control the omnidirectional light from the light engine.

Lens trim is designed to provide a diffused light. Lensed trims are normally found in wet locations. The luminous trims combine the diffused quality of lensed trim but with an open down light component. Adjustable trim allows for the adjustment of the light whether it is eyeball style, which protrudes from the trim or gimbal ring style, which adjusts inside the recess.

Figure 4:
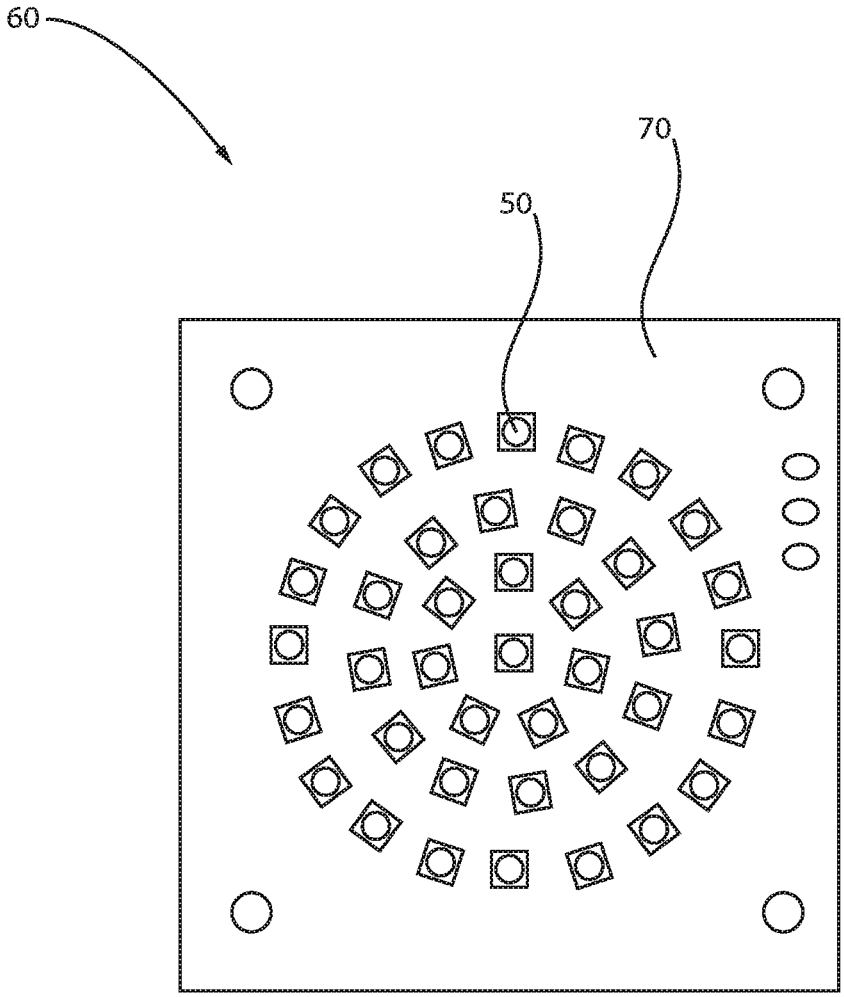
FIG. 4 is a perspective view of an interior of a junction box for the second housing including the driver electronics.
Figure 6:
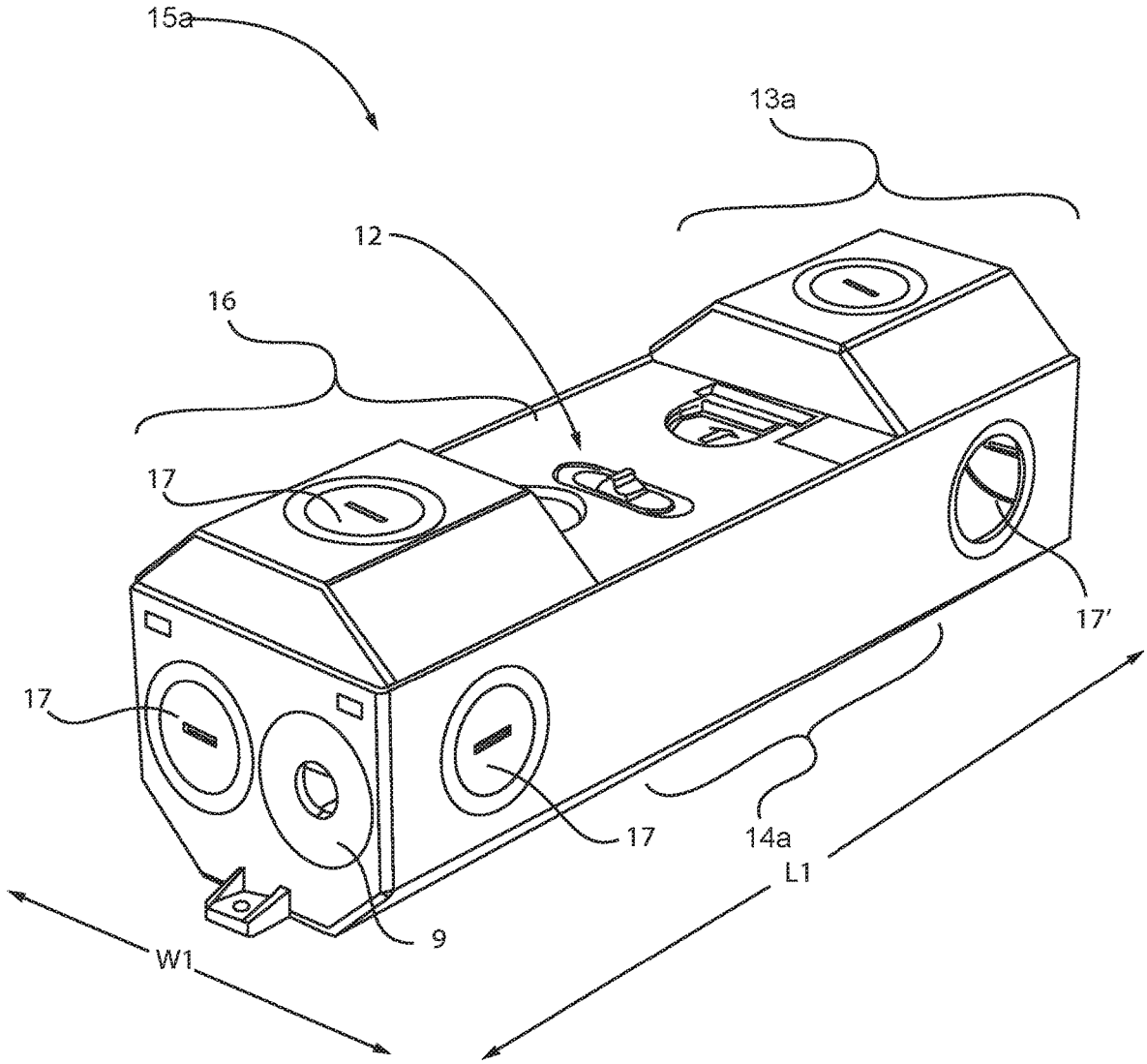
FIG. 6 is a perspective view of a driver electronics housing includes two laterally disposed compartments for electrical connections on opposing sides of a centrally positioned compartment including driver electronics, in accordance with one embodiment of the present disclosure.

FIG. 4 is a top down view of a light emitting diode (LED) light engine including at least one string of light emitting diodes (LEDs) as used in the light engine housing 10 of the downlight designs depicted in FIGS. 1-3, 10, 12, 13 and 14. The light engine (also referred to as light source) is positioned within the light engine housing 10 and orientated to emit light in a direction through opening of the light engine housing 10 at which the trim 5 is positioned. The light engine produces light from solid state emitters.

The term "solid state" refers to light emitted by solid-state electroluminescence, as opposed to incandescent bulbs (which use thermal radiation) or fluorescent tubes, which use a low pressure Hg discharge. Compared to incandescent lighting, solid state lighting creates visible light with reduced heat generation and less energy dissipation. Some examples of solid state light emitters that are suitable for the methods and structures described herein include inorganic semiconductor light-emitting diodes (LEDs), organic light-emitting diodes (OLED), polymer light-emitting diodes (PLED) or combinations thereof. Although the following description describes an embodiment in which the solid state light emitters are provided by light emitting diodes, any of the aforementioned solid state light emitters may be substituted for the LEDs. FIG. 4 illustrates one example of the light emitting diodes (LEDs) 50 of a light engine 60 that can be utilized within the downlights 100 that are depicted in FIGS. 1-3, 10, 12, 13 and 14.

Referring to FIG. 4, in some embodiments, the light source (also referred to as light engine) for the downlight 100 is provided by plurality of LEDs 50 that can be mounted to the circuit board 60 by solder, a snap-fit connection, or other engagement mechanisms. In some examples, the LEDs 50 are provided by a plurality of surface mount device (SMD) light emitting diodes (LED).

The circuit board 70 for the light engine 60 may be composed of a metal core printed circuit board (MCPCB). MCPCB uses a thermally conductive dielectric layer to bond circuit layer with base metal (Aluminum or Copper). In some embodiments, the MCPCB use either Al or Cu or a mixture of special alloys as the base material to conduct heat away efficiently from the LEDs thereby keeping them cool to maintain high efficacy. In some embodiments, other materials, such as FR4 can also be employed.

It is noted that the number of LEDs 50 on the printed circuit board 70 may vary. For example, the number of LEDs 50 may range from 5 LEDs to 70 LEDs. In another example, the number of LEDs 50 may range from 35 LEDs to 45 LEDs. It is noted that the above examples are provided for illustrative purposes only and are not intended to limit the present disclosure, as any number of LEDs 50 may be present the printed circuit board 70. In some other examples, the number of LEDs 50 may be equal to 5, 10, 15, 20, 25, 30, 35, 40, 45, 50, 55, 60, 65 and 70, as well as any range of LEDs 50 with one of the aforementioned examples as a lower limit to the range, and one of the aforementioned examples as an upper limit to the range. In some embodiments, chip on board (COB) light emitting diodes may be used in the light engine.

The LEDs 50 may be arranged as strings on the printed circuit board 70. When referring to a "string" of LEDs it is meant that each of the LEDs in the string are illuminated at the same time in response to an energizing act, such as the application of electricity from the driving electronics, e.g., driver, in the downlight 100. The LEDs 50 in a string of LEDs are electrically connected for this purpose. For example, when a string of LEDs 50 is energized for illumination, all of the LEDs in the string are illuminated. Further, in some embodiments, illuminating the first string of LEDs 50 does not illuminate the LEDs in the second string of LEDs 50, and vice versa, as they are independently energized by the driving electronics, and not electrically connected. It is also noted that the same LED may be shared by more than one string.

In some embodiments, the LEDs 50 of the downlight 100 are selected to be capable of being adjusted for the color of the light they emit. The term "color" denotes a phenomenon of light or visual perception that can enable one to differentiate objects. Color may describe an aspect of the appearance of objects and light sources in terms of hue, brightness, and saturation. Some examples of colors that may be suitable for use with the method of controlling lighting in accordance with the methods, structures and computer program products described herein can include red (R), orange (O), yellow (Y), green (G), blue (B), indigo (I), violet (V) and combinations thereof, as well as the numerous shades of the aforementioned families of colors. It is noted that the aforementioned colors are provided for illustrative purposes only and are not intended to limit the present disclosure as any distinguishable color may be suitable for the methods, systems and computer program products described herein.

The LEDs 50 of the downlight 100 may also be selected to allow for adjusting the "color temperature" of the light they emit. The color temperature of a light source is the temperature of an ideal black-body radiator that radiates light of a color comparable to that of the light source. Color temperature is a characteristic of visible light that has applications in lighting, photography, videography, publishing, manufacturing, astrophysics, horticulture, and other fields. Color temperature is meaningful for light sources that do in fact correspond somewhat closely to the radiation of some black body, i.e., those on a line from reddish/orange via yellow and more or less white to blueish white. Color temperature is conventionally expressed in kelvins, using the symbol K, a unit of measure for absolute temperature. Color temperatures over 5000 K are called "cool colors" (bluish white), while lower color temperatures (2700-3000 K) are called "warm colors" (yellowish white through red). "Warm" in this context is an analogy to radiated heat flux of traditional incandescent lighting rather than temperature. The spectral peak of warm-colored light is closer to infrared, and most natural warm-colored light sources emit significant infrared radiation. The LEDs 50 of the lamps provided by the present disclosure in some embodiments can be adjusted from 2K to 5K.

The LEDs 50 of the downlight 100 may also be selected to be capable of adjusting the light intensity/dimming of the light they emit. In some examples, dimming or light intensity may be measured using lumen (LM). In some embodiments, the dimming or light intensity adjustment of the LEDs 50 can provide for adjusting lighting between 100 LM to 2000 LM. In another embodiment, dimming or light intensity adjustment of the LEDs 50 can provide for adjusting lighting between 500 LM to 1750 LM. In yet another embodiment, the dimming or light intensity adjustment of the LEDs 50 can provide for adjusting lighting between 700 LM to 1500 LM.

In some embodiments, the LED light engines 60 for the downlight may provide the that downlight be an SMD (Surface Mount Diode) downlight and/or a COB (Chip on Board) downlights. In some embodiments, the LEDs 50 may be selected to be SMD type emitters, in which the SMDs are more efficient than COBs because the light source produces higher lumens per watt, which means that they produce more light with a lower wattage. In some embodiments, the SMD type LEDs 50 can produce a wider beam of light which is spread over a greater area when compared to light engines of COB type LEDs. This means that less material is needed for the heat sink, which in turn means that they are more economical. SMD downlights can be covered with a frosted diffuser which hides the LED chip array, and spreads the light evenly. SMD downlights can produce a wide spread of light. In some example, the wide beam angle of the light emitted from SMD downlights means they can be suitable for larger rooms like living rooms, bedrooms, kitchens and bathrooms.

A Chip On Board (COB) LED Downlight consists of a single LED chip, mounted on the downlight, compared to an array of LED's like an SMD. COB LEDs are basically multiple LED chips (typically nine or more) bonded directly to a substrate by the manufacturer to form a single module. The ceramic/aluminum substrate of COB LEDs also acts as a higher efficiency heat transfer medium when coupled to an external heatsink, further lowering the overall operating temperature of the assembly. Since the individual LEDs used in a COB are chips, the chips can be mounted such that they take up less space and the highest potential of the LED chips can be obtained. When the COB LED package is energized, it appears more like a lighting panel than multiple individual lights as would be the case when using several SMD LEDs mounted closely together. In some embodiments, because the single cluster of LED's 50 are mounted in one point, they can require greater cooling, so a heat sink, usually made of aluminum, may be mounted to dissipate the heat.

A light engine of COB type LEDs 50 can provide a more focused light and with the use of reflectors, the light beam can be more controlled when compared to a light engine that is composed of SMD LEDs. Chrome reflectors surrounding the diode can be replaced and set at different angles to make the light beam narrower or wider. Due to the narrow beam and with the use of reflectors that are usually clear, COB lights generate crisper and cleaner as there is no frosting on the lenses, which cuts down the clarity of the LED light. Due to the clear lenses, more light can penetrate further which means they perform well in rooms with high ceilings.

It is noted that the above description of the light emitting diodes (LEDs) 50 is provided for illustrative purposes only, and is not intended to limit the present disclosure. For example, In some embodiments, other light sources may either be substituted for the LEDs 50, or used in combination with the LEDs 50, such as organic light-emitting diodes (OLEDs), a polymer light-emitting diode (PLED), and/or a combination of any one or more thereof.

Figure 5:
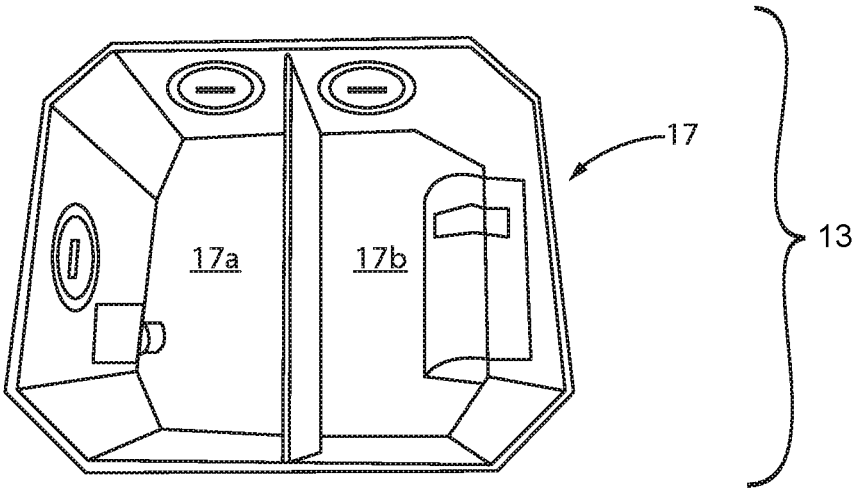
FIG. 5 is a top down view of a light emitting diode (LED) light engine including at least one string of light emitting diodes (LEDs) as used in the first housing of the lamp designs depicted in FIGS. 1-3.
Figure 10:
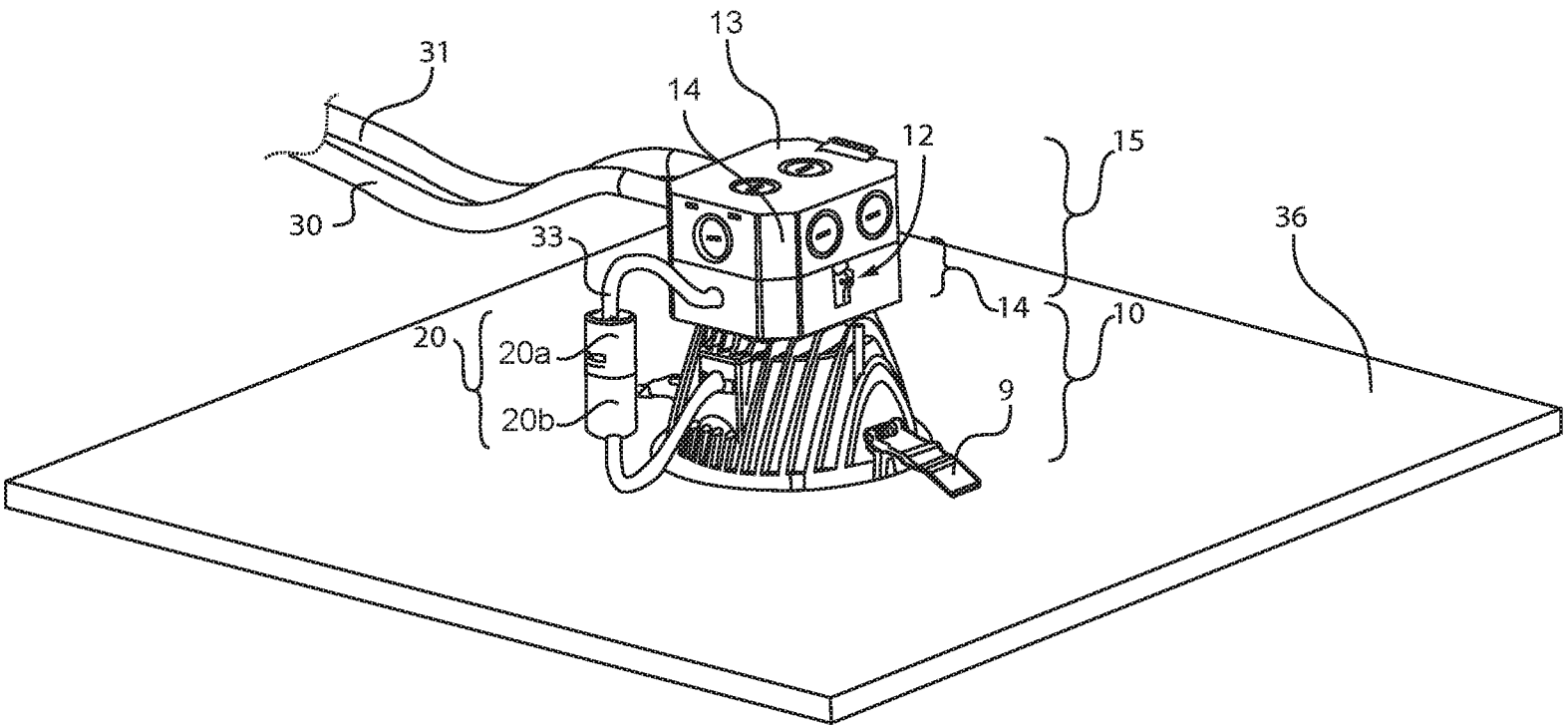
FIG. 10 is a perspective view of a downlight as depicted in FIGS. 1-5 being installed in a retrofit application, in accordance with one embodiment of the present disclosure.
Figure 12:
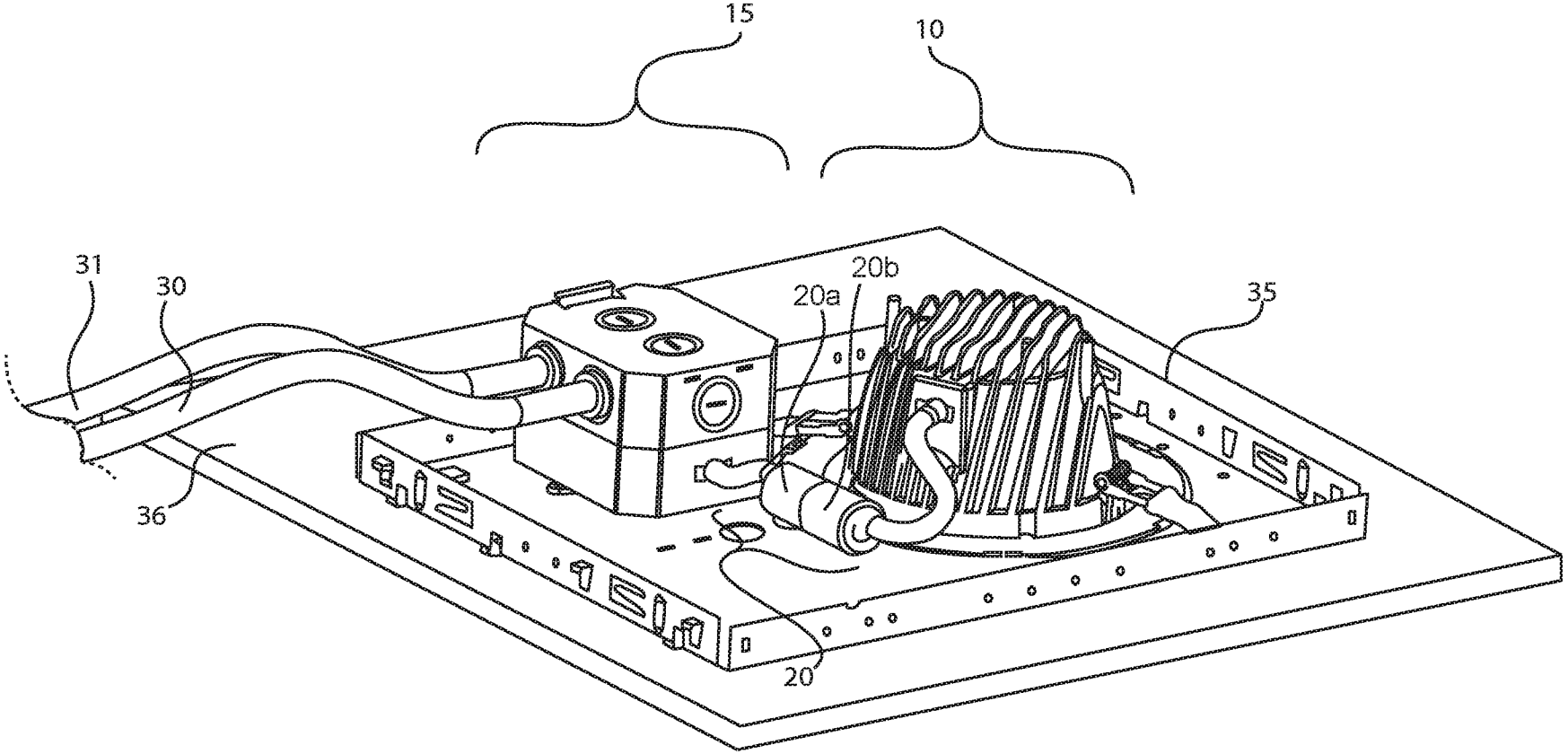
FIG. 12 is a perspective view of a downlight as depicted in FIGS. 1-5 being installed in a new construction application, in accordance with one embodiment of the present disclosure.
Figure 14:
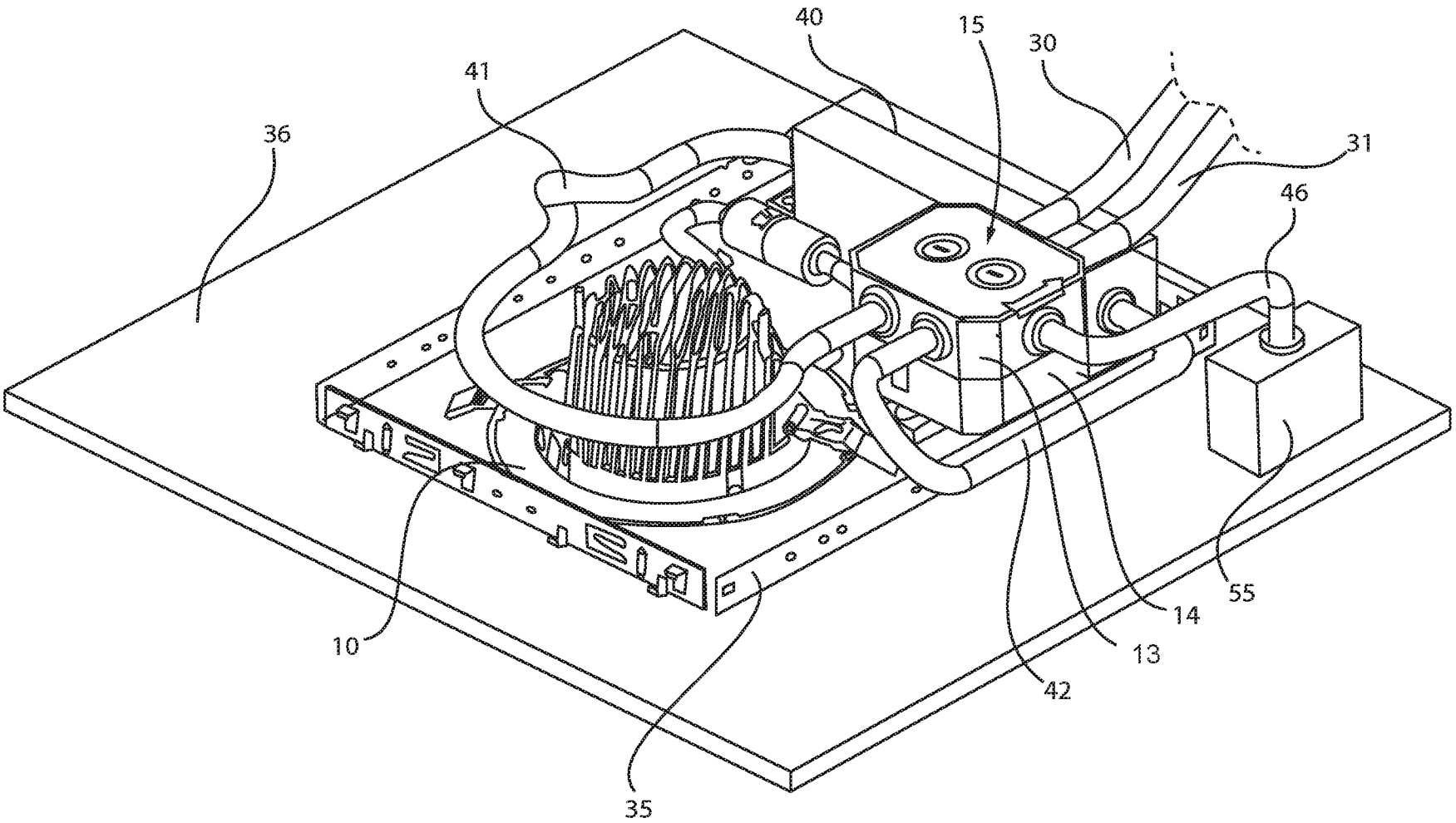
FIG. 14 is a perspective view of a downlight as depicted in FIGS. 1-5 further including an auxiliary power source, in accordance with one embodiment of the present disclosure.

Referring to FIGS. 1-3, 5, 10, 12, 14, 16, 18 and 21, the driver electronics housing 15 of the downlight may include a vertical stack of a driver electronics level 14 including the driver electronics (which are further described below with reference to FIG. 15) and a junction box level 13 that includes the main power connection. FIG. 3 illustrates one embodiment of the driver electronics housing 15, in which the cover 18 is removed to expose an internal surface of the junction box level 13. FIG. 5 illustrates one embodiment of the internal surfaces of compartments within the junction box level 13 of the driver electronics housing 15. The junction box level 13 may include includes two compartments 17*a*, 17*b*. The sidewalls of the junction box level 13 may include a plurality of knock-out openings. A "knock out" or "KO" is a partially stamped opening in electrical enclosures that allows quick entry of a wire, cable or pipe via connector or fitting to the interior. The knock out, e.g., openings, each lead to one of the compartments 17*a*, 17*b* of the junction box. In some embodiments, at least one of the compartments 17*a*, 17*b* of the junction box is for a main power connection 30, as depicted in FIGS. 10, 12, and 14. In some embodiments, at least one of the compartments 17*a*, 17*b* are for the connection to a dimming circuit, such as through a dimming wire 31, as depicted in FIGS. 10, 12 and 14. In some further embodiments, the compartments 17*a*, 17*b* for the junction box level 13 may also include connections for an auxiliary power module, such as an emergency backup battery 40, as depicted in FIG. 14. The compartments 17*a*, 17*b* are sufficiently large to allow for light assemblies to be daisy chained together. In one embodiment, the compartments 17*a*, 17*b* may each of a volume of 10 cubic inches or greater. This is only one example, and other examples are equally applicable. For example, the compartments 17*a*, 17*b* may have a volume ranging from 9 cubic inches to 15 cubic inches. In one example, the compartments 17*a*, 17*b* have a volume of 12 cubic inches. The junction box level 13, as well as, the entirety of the driver electronics housing 15 may be composed of a plastic, such as polycarbonate. In some embodiments, the driver electronics housing 15 may be composed of a metal.

The driver electronics housing 15 is vertically orientated to provide that the driver electronics are positioned in a first level (driver electronics level 14) of the driver electronics housing 15 and a junction box is present on a second level (junction box level 13) of the driver electronics housing 15. The junction box in the junction box level 13 provides the connection point for a main power connection from the power source. The driver electronics level of the box that contains the driver electronics is referred to with reference number 14, and provides the connection point for the first terminal 20*a* of the driver to light source power connector 20.

Referring to FIGS. 1-3, 5, 10, 12, 14, 16, 18 and 21, the driver electronics housing 15 is vertically orientated to provide that the driver electronics are positioned in a first level referred to as the driver electronics level 13 of the driver electronics housing 15, and a junction box is present in a second level referred to as a junction box level 13 of the driver electronics housing 15 to provide that a main power connection from the power source to the junction box and a driver to light source power connection are vertically offset V1 from one another. By "vertically offset" it is meant that the connection point for the main power at the junction box level 13 of the driver electronics housing 15 is on a different plane than the connection point at the electronics driver level 17 of the driver electronics housing 15. The electrical connections for the main power to the junction box level 13 of the driver electronics housing 15 may be through openings (also referred to as punch outs) that are formed through sidewalls of the driver electronics housing 15.

Referring to FIGS. 10, 12 and 14, the main power wire is identified by reference number 30 and enters the junction box level 13 of the driver electronics housing 15, which contains the main power connection to the driver electronics. The main power wire 30 may provide to the downlight a universal input voltage, e.g., a voltage ranging from 120V to 277V. In some further examples, the main power wire 30 may provide an input voltage of 347V. An input voltage of 120-277V can be suitable for commercial applications. Referring to FIGS. 10, 12 and 14, in some embodiments, the input voltage can be 120V, which can be suitable for both residential and commercial applications. Referring to FIGS. 10, 12 and 14, in addition to the main power wire 30, the junction box level 13 may also include a connection for dimming controls, i.e., dimming wire connection, in which the wiring for dimming is identified by reference number 31. In some embodiments, the downlight 100 described herein may have a diming wire 31 that provides for 0-10V and phase dimmable applications. In some instances, the dimming wire 31 does not provide phase dimming, only 0-10V (or potentially DALI type of dimming). The phase dimming occurs through the main power phase being cut, connected in wire 30. Referring to FIG. 14, in some embodiments, the junction box level 13 may also include connections for auxiliary power 40, such as a battery backup, e.g., emergency battery backup.

Referring to FIGS. 1-3, 5, 10, 12 and 14, in some embodiments, the driver electronics housing 15 includes at least one switch 12 for selecting a light characteristic for the light projected by the light emitting diode (LED) light source of the light engine housing 10. The at least one switch 12 for selecting the light characteristic may select at least one of a lumen setting and/or a correlated color temperature (CCT) setting for the light being emitted by the light engine of the downlight. In FIGS. 1-3 and 5-8, the at least one switch 12 is a single switch for selecting the lumens of the light being projected by the light engine. The single switch 12 for selecting the lumens of light being projected by the light engine may include three light settings for the lumens. For example, a light engine in a 6" housing, e.g., first housing 10, for a light source being powered by a selectable power setting of 8 watts, 10 watts, or 12 watts may have three lights settings of 700 lumens, 900 lumens and 1100 lumens, respectively, in which the three light settings are selected using the single switch 12. In another example, a light engine in a 6" housing, e.g., first housing 10, for a light source being powered by a selectable power setting of 12 watts, 14 watts, or 16 watts may have three lights settings of 1100 lumens, 1300 lumens and 1500 lumens, respectively, in which the three light settings are selected using the single switch 12. In yet another example, in which the light emitting diode (LED) light engine is present in a housing, e.g., first housing 10, having an 8" diameter, the light source can be powered by a selectable power setting of 11 watts, 16 watts, or 21 watts may have three light settings of 1000 lumens, 1500 lumens and 2000 lumens, respectively, in which the three light settings are selected using the single switch. In an even further example, in which the light emitting diode (LED) light engine is present in a housing, e.g., first housing 10, having an 8" diameter, the light source can be powered by a selectable power setting of 31 watts, 41 watts, or 51 watts may have three light settings of 3000 lumens, 4000 lumens and 5000 lumens, respectively, in which the three light settings are selected using the single switch.

In some embodiments, the at least one switch 12 for selecting each of the settings may be a toggle switch, a pushbutton switch, and/or a selector switch. Toggle switches are actuated by a lever angled in one of two or more positions. Pushbutton switches are two-position devices actuated with a button that is pressed and released. Selector switches are actuated with a rotary knob or lever of some sort to select one of two or more positions. Like the toggle switch, selector switches can either rest in any of their positions or contain spring-return mechanisms for momentary operation. It is noted that the above examples are provided for illustrative purposes only, and are not intended to limit the types of switches that are to be used in accordance with the present disclosure. Any switch used to interrupt the flow of electrons in a circuit can be suitable for use as a switch 12 for selecting settings for the lumen output of the light emitted by the downlight and/or selecting the correlated color temperature (CCT) of the light emitted by the downlight 100. In one example, a simplest type of switch is one where two electrical conductors are brought in contact with each other by the motion of an actuating mechanism.

In one embodiment, the downlight includes at least two switches 12, e.g., a first switch for selecting at least one lumen setting for the light emitted by the light engine; and a second switch for selecting at least one correlated color temperature (CCT). Examples of different light settings for the first switch directed to different lumen levels have been described above.

Examples of different correlated color temperature (CCT) settings for the second switch may include a first correlated color temperature (CCT) setting of 2700K, a second correlated color temperature (CCT) setting of 3500K, and a third correlated color temperature (CCT) setting 4000K.

It is noted that the number of selectable settings can be provided by the at least one switch 12 that is depicted in FIGS. 1-3 and 5-8. For example, the number of selectable settings that may be selected using the at least one light switch may be equal to 2, 3, 4, 5, 6, 7, 8, 9 and 10, as well as any range for the number of selectable settings including a lower limit provided by one of the aforementioned examples, and an upper limit provided by one of the aforementioned examples. Further, the values for the selectable settings, e.g., lumen settings and correlated color temperature (CCT) settings, are not limited to those described above and depicted in FIGS. 1-3 and 5-8.

For example, in addition to the above described lumen levels, the at least one switch may select at least one lumen setting, e.g., selected from 500 LM, 600 LM, 700 LM, 800 LM, 900 LM, 1000 LM, 1100 LM, 1200 LM, 1300 LM, 1400 LM, 1500 LM, 1600 LM, 1700 LM, 1800 LM, 1900 LM and 2000 LM, as well as any range for the lumens associated with the light emitted by the downlight including a lower limit provided by one of the aforementioned examples, and an upper limit provided by one of the aforementioned examples.

For example, the at least one switch 12 may select at least one correlated color temperature (CCT) setting selected from 2500K, 2600K, 2700K, 2800K, 2900K, 3000K, 3100K, 3200K, 3300K, 3400K, 3500K, 3600K, 3700K, 3800K, 3900K, 4000K, 4100k, 4200K, 4300K, 4400K, 4500K, 5000K, 5500K, 6000K and 6500K, as well as any range for the correlated color temperature (CCT) associated with the light emitted by the downlight including a lower limit provided by one of the aforementioned examples, and an upper limit provided by one of the aforementioned examples.

The at least one switch 12 may be mounted to the sidewall of the driver electronics housing 15 on the first electronics level 14 of the driver electronics housing 15. For example, the at least one switch 12 may be mounted proximate to the driver electronics, e.g., on the same level, as the driver electronics. This provides that the at least one switch 12 is in electrical communication with the driver electronics, which are in turn in electrical communication with the light engine that is contained in the light engine housing 10. The driver electronics in the driver electronics housing 15 are in electrical communication through the reversible driver to light source connector 20.

In some embodiments, in addition to the light engine being in electrical communication with the at least one switch 12 for selecting lighting characteristics, the light engine may also be in electrical communication with a receiver for receiving setting commands for dimming and intensity of the light being emitted by the downlight. In some embodiments, the dimming function may be controlled through a 0-10V dimming wall switch. The 0-10V dimming wall switch is remotely mounted from the housing 10 of the downlight 100. The 0-10V dimming wall switch communicates with a 0-10V dimming circuit 206 in the electronics package 200 of the downlight 100.

In some embodiments, the driver electronics housing 15, e.g., junction box/electronic driver box, is separable from the light engine housing 10, e.g., light engine/reflector, so that the junction box/electronic driver box can be easily retrofitted in place or mounted to a new tray in new construction. To provide that the driver electronics housing 15 is separable from the light engine housing 10, a reversible driver to light source connector 20 is provided for electrically connecting the light engine housing 10 containing the light emitting diode (LED) light source and the driver electronics housing 20 including the driver electronics. In some embodiments, the reversible driver to light source connector 20 is a connector having a second terminal 20*b* that is engaged to the light emitting diode (LED) light source in the light engine housing 10 and a first terminal 20*a* that is engaged to the driver electronics in the driver electronics housing 15. In some embodiments, the first terminal 20*a* is a male terminal, and the second terminal 20*b* is a female terminal. In some embodiments, the first terminal 20*a* is a female terminal, and the second terminal 20*b* is a male terminal. In one embodiment, the first and second terminals 20*a*, 20*b* screw together to provide the electrical connection. The first and second terminals 20*a*, 20*b* may then be screwed apart in an opposite direction from which they were screwed together. Generally, the first and second terminals include a housing containing terminal contacts. In some embodiments the housings for the first and second terminals are threaded to provide that they can be screwed together. In other embodiments, the first and second terminals 20*a*, 20*b* are provided by terminal blocks, such as terminal blocks with screw terminals, terminal blocks with barrier terminals, terminal blocks with push-fit terminals, terminal blocks with pluggable terminals and combinations thereof.

One of the male terminal and the female terminal is engaged through wired connection to the light emitting diode (LED) light engine in the light engine housing 10, while the other of the male terminal and the female terminal is engaged through wired connection to the driver electronics of the driver electronics housing 15.

Referring to FIGS. 1-3 and 5-8, the wired connection from the driver electronics of the driver electronics housing 15 that is terminated with the first terminal 20*a* is present through knockout in the driver electronics level 14 of the driver electronics housing 15, and is vertically offset from the knockout that the power line 31 is present through the junction box level 13 of the driver electronics housing 15.

The present disclosure is not limited to these examples, in which the driver electronics housing 15 includes a vertical stack, i.e., is vertically orientated, of a driver electronics level 14 and a junction box level 13. For example, in other embodiments, the driver electronics housing 15 that is depicted in FIGS. 1, 2, 3, 5, 10, 12 and 14 may be substituted with a driver electronics housing 15*a* including two laterally disposed compartments 13', 16 for electrical connections on opposing sides of a centrally positioned compartment 14 including driver electronics, as depicted in FIGS. 6-9. The driver electronics housing 15*a* that is depicted in FIGS. 6-9 is a component of a two housing light structure similar to the embodiments described above with reference to FIGS. 1, 2, 3, 5, 10, 12 and 14. The light engine housing 10 and the reversible driver to light source connector 20 that has been described with reference to FIGS. 1, 2, 3, 5, 10, 12 and 14 are equally applicable to the light structures that include the driver electronics housing 15*a* that is depicted in FIGS. 6-9. Therefore, the elements for the light engine housing 10 and the reversible driver to light source connector 20, as well as other structures having reference numbers described above, in the description of FIGS. 1, 2, 3, 5, 10, 12 and 14 are equally applicable to similar structures having the same reference numbers in FIGS. 6-9, 11 and 13.

FIGS. 6-9 depict one embodiment of a driver electronics housing 15*a* includes two laterally disposed compartments 13*a*, 16 for electrical connections on opposing sides of a centrally positioned compartment 14*a* (also referred to as a driver electronics compartment 14*a*) including driver electronics. The driver electronics housing 15*a* may have a width W1 perpendicular to direction separating the two laterally disposed compartments of 5 inches or less. This provides that the driver electronics housing 15*a* can be installed into the ceiling through an opening for a light engine housing having a diameter or 5 inches or less, e.g., an opening for a 4" light engine housing, or an opening for a 3" light engine housing.

FIGS. 6-9 depict one embodiment of a driver electronics housing 15*a* including two laterally disposed compartments 13*a*, 16 for electrical connections on opposing sides of a centrally positioned compartment 14*a* including driver electronics. In some embodiments, a first compartment 13*a* of the two laterally disposed compartments includes a main power connector for connection to a main power source. In some embodiments, a second compartment 16 of the two laterally disposed compartments includes a dimming control electrical connection for a dimming circuit for dimming the light emitted by the light source. In some embodiments, the second compartment 16 of the two laterally disposed compartments includes an auxiliary power connection for electrical connection with a battery backup.

The driver electronics housing 15*a* is laterally orientated to provide that the driver electronics are within a driver compartment 14*a* that is positioned between a first compartment 13*a* including a main power connection on a first side of the driver compartment 14*a*, and a second compartment 16 including at least one of a connection for a dimming control electrical connection or a connection for an auxiliary power connection. The length L1 of the driver electronics housing 15*a* extends from an exterior end of the first compartment 13*a* across the driver compartment 14*a* to an opposing exterior end of the second compartment 16. The width W1 of the driver electronics housing 15*a* is perpendicular to the length L1 of driver electronics housing 15*a*. The width W1 of the driver electronics housing 15*a* is less than 5 inches. The width W1 of the driver electronics housing 15*a* is less than 5 includes to fit within small diameter openings for small diameter light engine housings. For example, the width W1 of the driver electronics housing 15*a* may be selected to provide that the driver electronics housing 15*a* can be passed through the opening in a ceiling for a 4" light engine housing, e.g., a reflector and light engine combination. In another example, the width W1 of the driver electronics housing 15*a* may be selected to provide that the driver electronics housing 15*a* can be passed through the opening in a ceiling for a 3" light engine housing, e.g., a reflector and light engine combination. The length L1 is greater than the width W1 of the driver electronics housing 15*a*. For example, the length L1 of the driver electronics housing 15*a* is at least 1.5 times (1.5×) greater than the width W1 of the driver electronics housing 15*a*. In another example, the length L1 of the driver electronics housing 15*a* is at least two times (2.0×) greater than the width W1 of the driver electronics housing 15*a*. In yet another example, the length L1 of the driver electronics housing 15*a* is at least 2.5 times (2.5×) greater than the width W1 of the driver electronics housing 15*a*.

In a further example, the length L1 of the driver electronics housing 15*a* is at least 3.0 times (3.0×) greater than the width W1 of the driver electronics housing 15*a*. It is noted that any range of values is equally applicable to the relationship of the length L1 and width W1 of the driver electronics housing 15*a*. For example, the length L1 of the driver electronics housing 15*a* may range from being 1.5 times (1.5×) to 3 times (3×) greater than the width W1 of the driver electronics housing 15*a*. In another example, the length L1 of the driver electronics housing 15*a* may range from 1.5 times (1.5×) to 2.5 times (2.5×) greater than the width W1 of the driver electronics housing 15*a*. In one example, the width W1 of the driver electronics housing 15*a* is 5 inches or less. In one example, the width W1 of the driver electronics housing 15*a* may be equal to approximately 2.75" and the length L1 of the driver electronics housing 15*a* may be equal to approximately 8". The width W1 of less than 3" allows for the driver electronics housing 15*a* to be passed through an opening of 4 inches or less, e.g., 3", which can allow for a installing the driver electronics housing 15*a* into a ceiling from a room side of a ceiling through a small diameter opening.

Referring to FIGS. 6-9, the light engine housing 15*a* is laterally orientated (also referred to as laterally disposed) to provide that the first compartment 13*a* including the main power connection, the driver electronics compartment 14*a*, and the second compartment 16 including at least one of the connection for a dimming control electrical connection or a connection for an auxiliary power connection are present in line substantially on a same level along the direction parallel to the length L1 of the driver electronics housing 15*a*. As noted above, the length L1 of the driver electronics housing 15*a* is greater than the width W1 of the driver electronics housing 15*a*.

The electrical connections for the main power to the first compartment 13*a* to the driver electronics, and the electrical connections for at least one of the connection for a dimming control electrical connection or a connection for an auxiliary power connection to the second compartment 16, may be through openings 17 (also referred to as punch outs/knock outs) that are formed through sidewalls of the driver electronics housing 15*a*. The main power connection within the first compartment 13*a* provides the connection point for a main power from the power source. This connection may provide the connection point for the driver to light source power connection.

The sidewalls of the driver electronics housing 15*a* includes a plurality of knock-out openings 17. The knock-out, e.g., openings, each lead to one of the compartments 13*a*, 16 of the driver electronics housing 15*a*. Reference number 17' illustrates an opening after the knockout has been removed. In one example, a knockout is removed, and a grommet 9*a* is installed in its place. The grommet 9*a* may provide a seal for a wire and wire sheathing that extends through an opening provided by removing the knockout.

The driver electronics housing 15*a* is a component of a light structure. The knockout electronics housing 15*a* is connected to a light engine housing 10 through a reversible driver to light source connector 20 for electrically connecting the light engine housing 10 containing the light emitting diode (LED) light source and the driver electronics housing 15*a* including the driver electronics. In some embodiments, a first end 20*a* of the reversible driver to light source connector 20 is engaged to the driver electronics through a first wired electrical pathway 33. In some embodiments, the first terminal 20*a* that is in electrical communication to driver electronics by wired connection, e.g., the first wired electrical pathway 33, is extending through a second compartment 16 of the two laterally disposed compartments for electrical connections.

Figure 7:
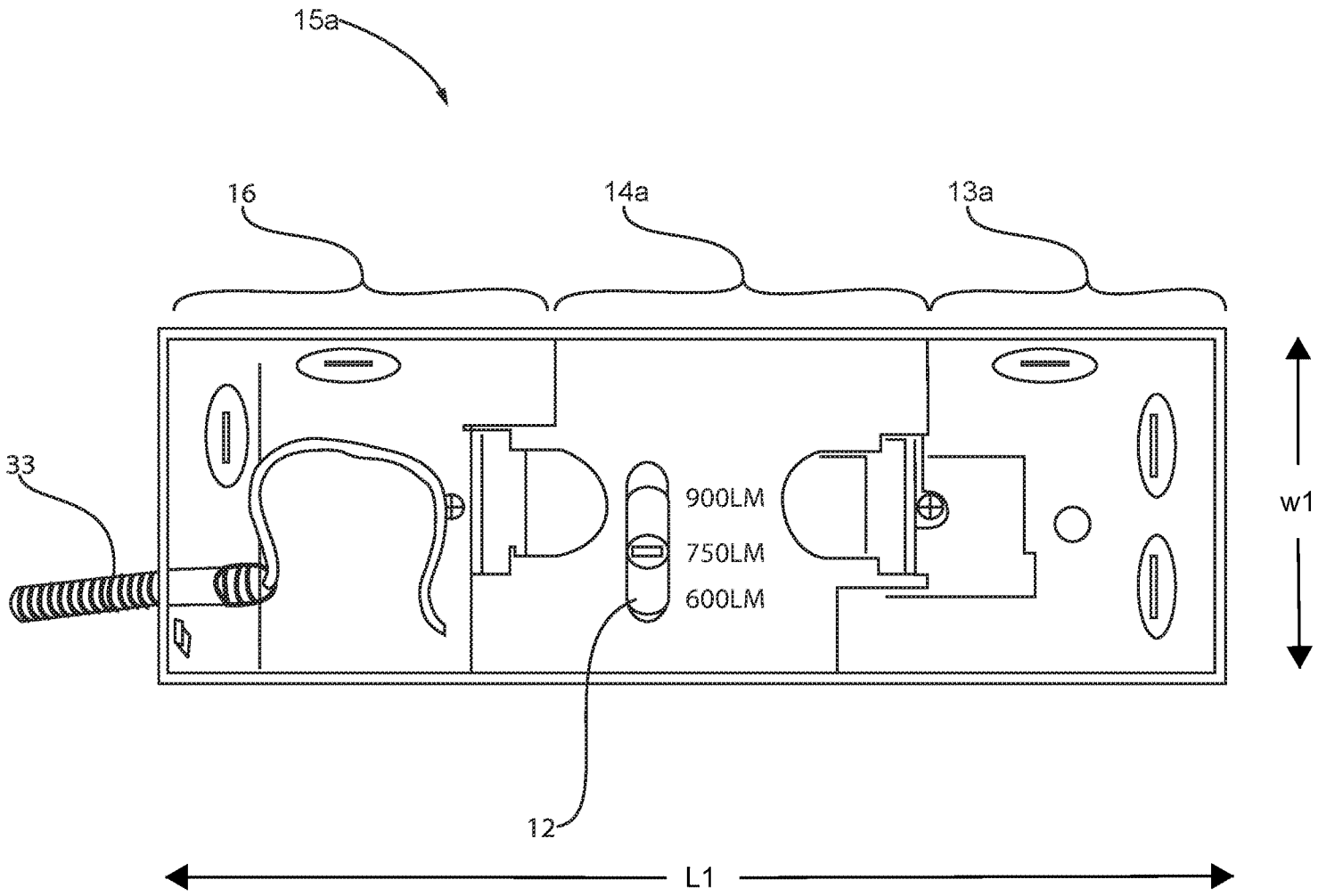
FIG. 7 is a down view depicting one embodiment of the driver electronics housing, in which the covers for the two laterally disposed compartments are removed to illustrate how the terminal that is in electrical communication to driver electronics by wired connection extends through the a compartment of the two laterally disposed compartments to the centrally housed driver electronics.
Figure 8:
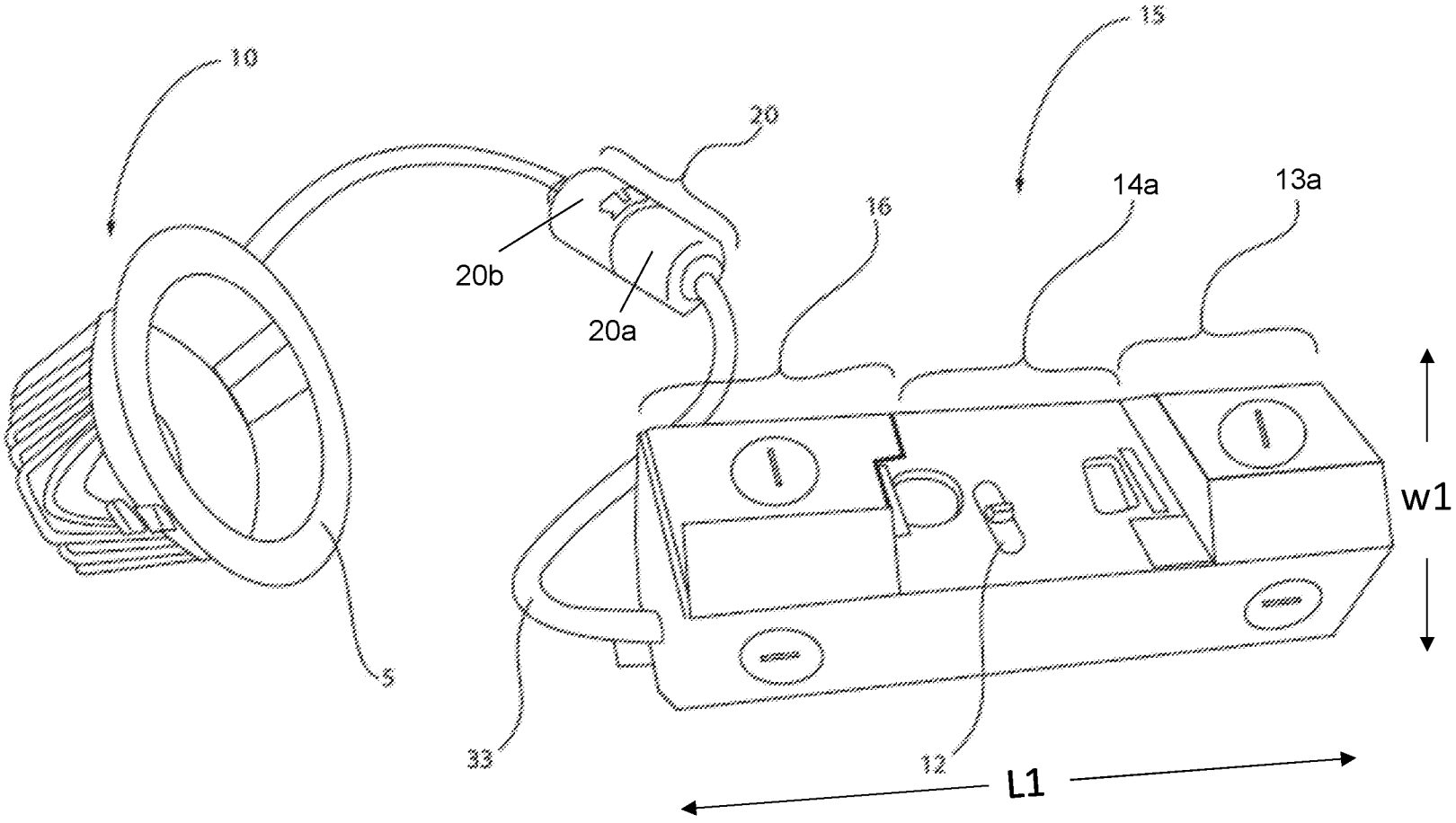
FIG. 8 is a perspective view of one embodiment of a downlight including a driver electronics housing including two laterally disposed compartments for electrical connections on opposing sides of a centrally positioned compartment including driver electronics, a light engine housing having a recessed down light structure geometry for containing a light emitting diode (LED) light source, and a reversible driver to light source connector for electrically connecting the light engine housing containing the light emitting diode (LED) light source and the driver electronics housing.
Figure 9:
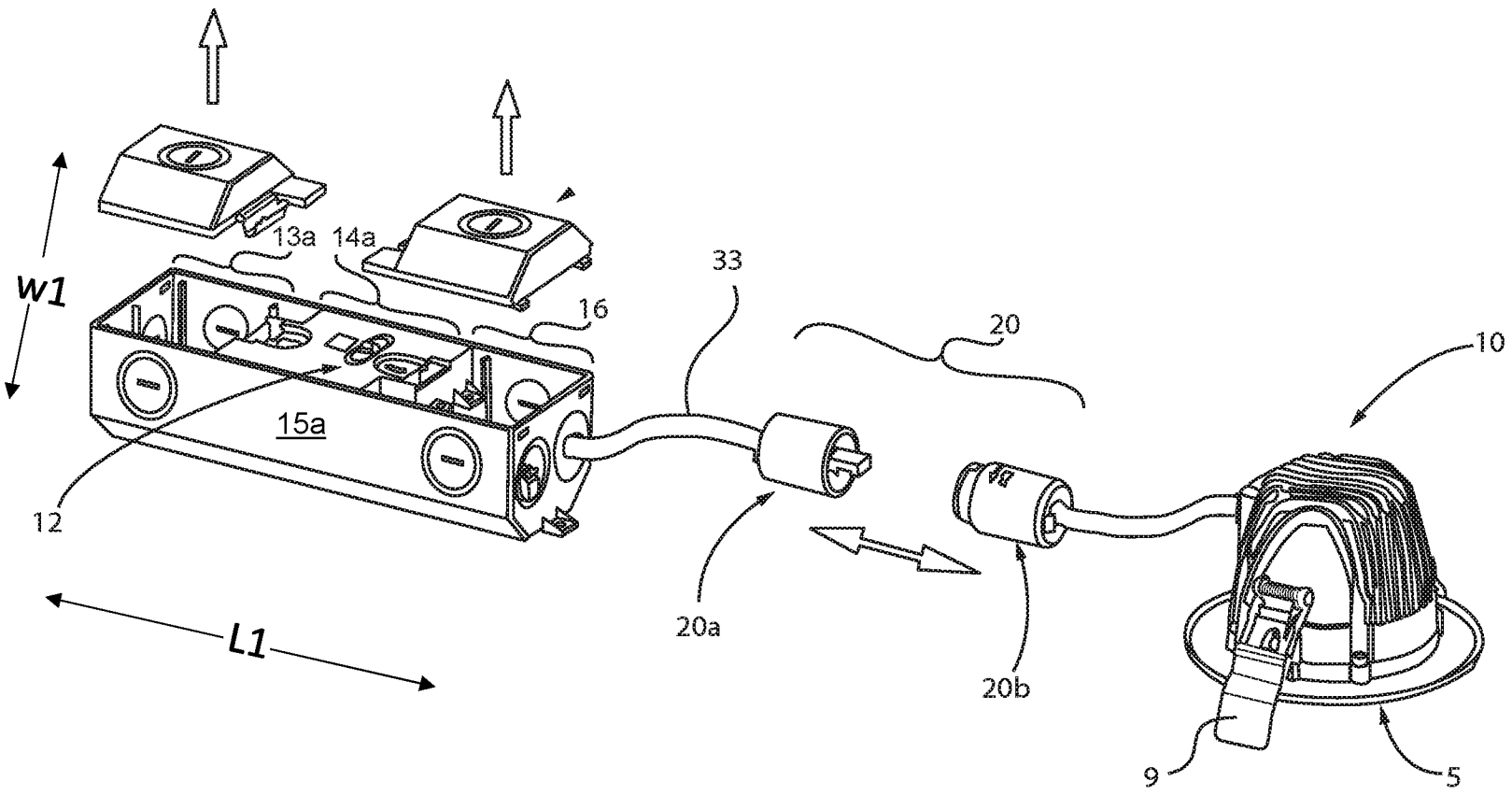
FIG. 9 is an exploded view of the light structure depicted in FIG. 8, in accordance with one embodiment of the present disclosure.

FIGS. 7 and 9 depict one embodiment of a driver electronics housing 15*a* in which the covers for the two laterally disposed compartments of the driver electronics housing 15*a* are removed. FIG. 7 illustrates one embodiment of the first wired electrical pathway 33 extending through the opening through the exterior sidewall of the second compartment 16. The first wired electrical pathway, i.e., wiring, passes through the second compartment 16 and extends into the driver electronics compartment 14*a*. The first wired electrical pathway 33 is in electrical communication with the drive electronics within the driver electronics compartment 14*a*.

In one embodiment, the first and second compartments 13*a*, 16 may each of a volume of 10 cubic inches or greater. This is only one example, and other examples are equally applicable. For example, the compartments 13*a*, 16 may have a volume ranging from 9 cubic inches to 15 cubic inches. In one example, the compartments 13*a*, 16 have a volume of 12 cubic inches. The driver electronics housing 15*a*, as well as, the entirety of the driver electronics housing 15*a* may be composed of a plastic, such as polycarbonate. In some embodiments, the driver electronics housing 15*a* may be composed of a metal.

The driver electronics housing 15*a* may have a multi-sided cylindrical geometry. For example, the driver electronics housing 15*a* may have an octagonal geometry, e.g., having eight sides.

Referring to FIGS. 6-9, the driver electronics (which are further described below with reference to FIG. 15) within the driver electronics compartment 14*a* are in communication with a switch 12 for setting lighting characteristics present on an exterior of the driver electronics housing 14*a*. The light characteristics selected through the switch 12 are projected by the light engine in the light engine housing 10 that are connected to the driver electronics through the reversible driver to light source connector 20. The at least one switch 12 for selecting the light characteristic may select at least one of a lumen setting and/or a correlated color temperature (CCT) setting for the light being emitted by the light engine of the downlight. In FIGS. 1-5 and 7-9, the at least one switch 12 is a single switch for selecting the lumens of the light being projected by the light engine. The single switch 12 for selecting the lumens of light being projected by the light engine may include three light settings for the lumens. For example, a light engine in a 3" housing, e.g., light engine housing 10, for a light source being powered by a selectable power setting of 4 watts, 5 watts, or 6 watts may have three lights settings of 350 lumens, 450 lumens and 500 lumens, respectively, in which the three light settings are selected using the single switch 12. In another example, a light engine in a 4" housing, e.g., light engine housing 10, for a light source being powered by a selectable power setting of 7 watts, 9 watts, or 10.5 watts may have three lights settings of 600 lumens, 750 lumens and 900 lumens, respectively, in which the three light settings are selected using the single switch 12.

In some embodiments, the at least one switch 12 for selecting each of the settings may be a toggle switch, a pushbutton switch, and/or a selector switch. Toggle switches are actuated by a lever angled in one of two or more positions. Pushbutton switches are two-position devices actuated with a button that is pressed and released. Selector switches are actuated with a rotary knob or lever of some sort to select one of two or more positions. Like the toggle switch, selector switches can either rest in any of their positions or contain spring-return mechanisms for momentary operation. It is noted that the above examples are provided for illustrative purposes only and are not intended to limit the types of switches that are to be used in accordance with the present disclosure. Any switch used to interrupt the flow of electrons in a circuit can be suitable for use as a switch 12 for selecting settings for the lumen output of the light emitted by the downlight and/or selecting the correlated color temperature (CCT) of the light emitted by the downlight 100. In one example, a simplest type of switch is one where two electrical conductors are brought in contact with each other by the motion of an actuating mechanism.

It is noted that the switch 12 on the driver electronics housing 15*a* including two laterally disposed compartments 13*a*, 16 for electrical connections on opposing sides of a centrally positioned compartment 14*a* including the driver electronics that is depicted in FIGS. 6-9, 11 and 13 is similar to the switch 12 on the driver electronics housing 15 including the vertical stack of the driver electronics level 14 and a junction box level 13 that is depicted in FIGS. 1-3, 5, 10, 12, 14, 16, 18 and 21. Therefore, further description regarding the switch 12 and the lighting characteristics that can be selected through the switch 12 for the laterally disposed housing depicted in FIGS. 6-9, 11-13 is provided by the description of the switch 12 that is described above with reference to FIGS. 1-3, 5, 10, 12, 14, 16, 18 and 21.

Figure 11:
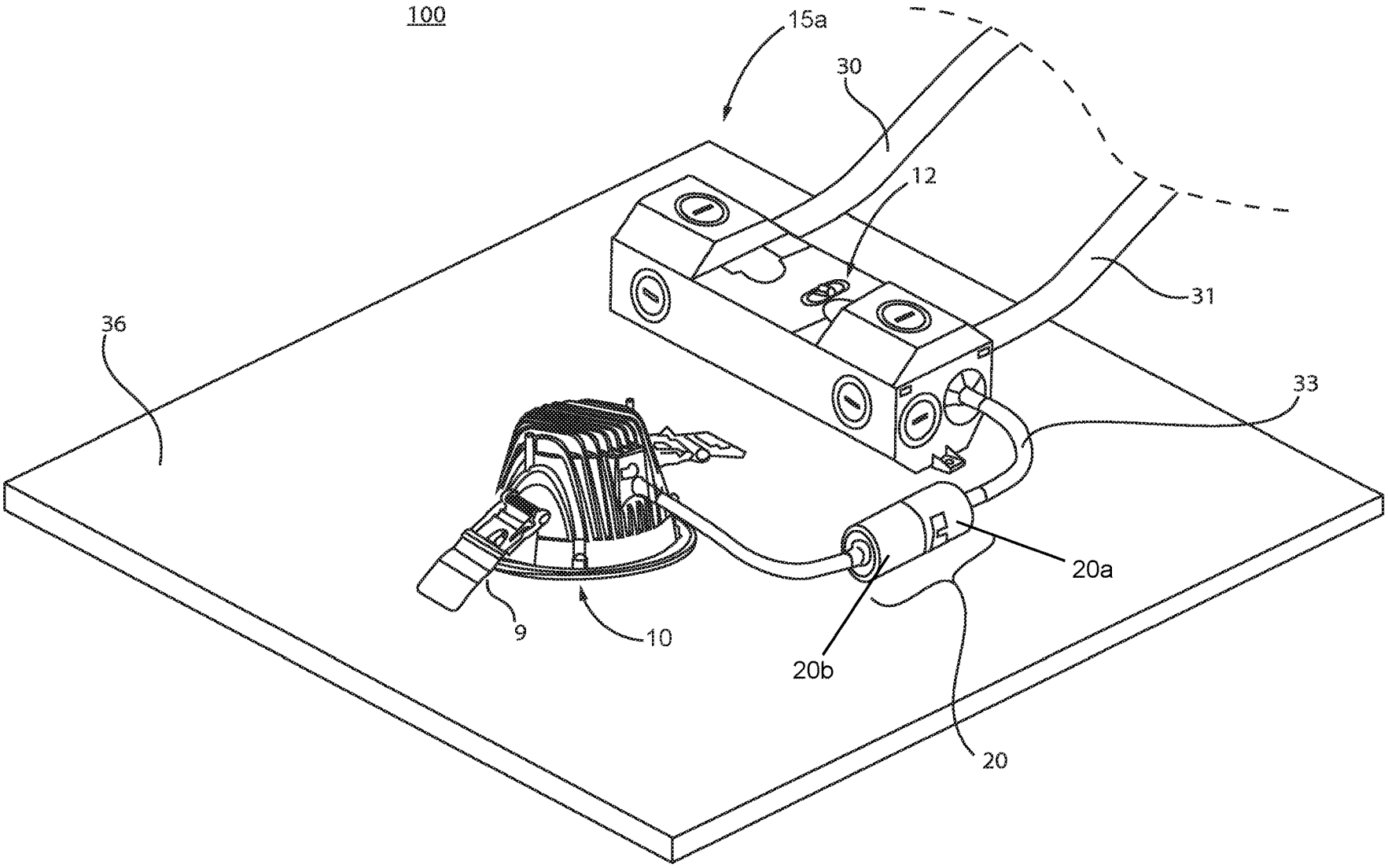
FIG. 11 is a perspective view of a downlight as depicted in FIGS. 6-9 being installed in a retrofit application, in accordance with one embodiment of the present disclosure.
Figure 13:
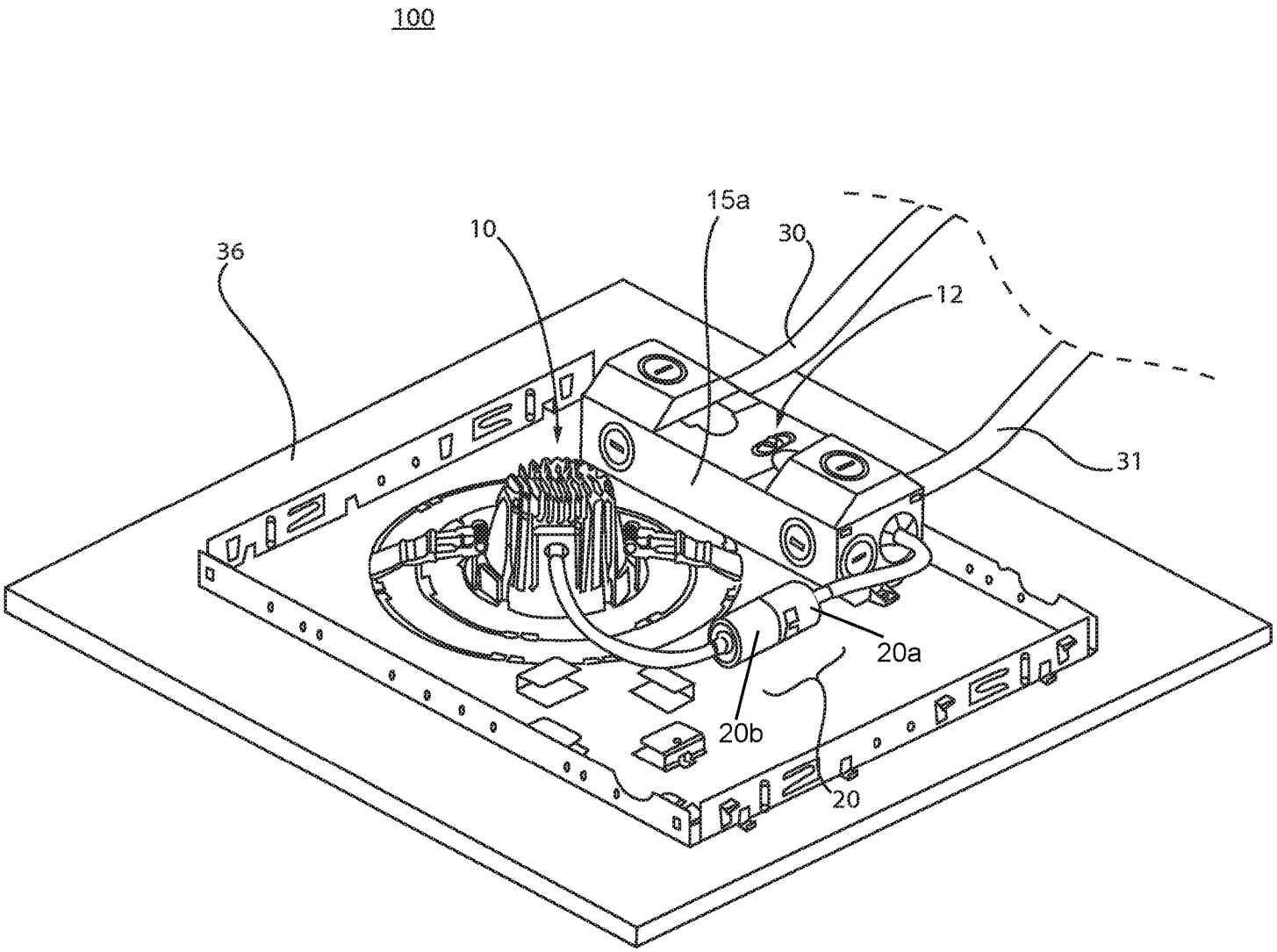
FIG. 13 is a perspective view of a downlight as depicted in FIGS. 6-9 being installed in a new construction application, in accordance with one embodiment of the present disclosure.

FIG. 10 depicts one embodiment of a downlight as depicted in FIGS. 1-5 being installed in a retrofit application. FIG. 11 depicts one embodiment of a downlight as depicted in FIGS. 6-9 being installed in a retrofit application. FIG. 12 depicts one embodiment of a downlight as depicted in FIGS. 1-5 being installed in a new construction application. FIG. 13 depicts one embodiment of a downlight as depicted in FIGS. 6-9 being installed in a new construction application.

The driver electronics housing 15, 15*a* is separable from the light engine housing 10, e.g., light engine/reflector, so that the junction box/electronic driver box can be easily retrofitted in place, as depicted in FIGS. 10 and 11, or mounted to a new tray in new construction, as depicted in FIGS. 12 and 13.

For example, FIG. 10 illustrates one embodiment of the downlight 100 being installed in a retrofit application. In this application, the driver electronics housing 15 may be positioned, i.e., vertically stacked, atop the light engine housing 10. In this embodiment, the driver electronics housing 15 is mounted to a back surface of the light engine housing 10 so that the driver electronics is positioned between the junction box level 13 and the light engine housing 10. This is a retrofit application, because the assembly of the vertically stacked light engine housing 10 and the driver electronics housing 15 is positioned into the ceiling through the hole that an original light assembly that is being replaced is removed through. In this application, the retrofit assembly can be installed into the ceiling from the room side of the ceiling panel 36. Referring to FIG. 11, the driver electronics housing 15*a* has a small diameter to provide for retrofit installation into a ceiling from a room side of the ceiling panel 36.

In the embodiment that is depicted in FIGS. 12 and 13, the light engine housing 10 is mounted to first portion of a mounting bracket 35 affixed to a ceiling panel 36, and the driver electronics housing 15, 15*a* is mounted to a second portion of the mounting bracket 35 that is affixed to the ceiling panel 36.

FIG. 14 illustrates one embodiment of a light assembly 100 including an auxiliary backup power 40. In the embodiment that is depicted in FIG. 14, the driver electronics housing 15 includes a vertical stack of a driver electronics level 14 and a junction box level 13, as depicted in FIGS. 1-3. It is noted that the driver electronics housing 15*a* including two laterally disposed compartments 13*a*, 16 for electrical connections on opposing sides of a centrally positioned compartment 14*a* including driver electronics that has been described above with reference to FIGS. 6-9 can be substituted for the vertically stacked box identified by reference number 15*a* in FIG. 14.

In some embodiments, a backup battery 40 is connected to the driver electronics that is present in driver electronics level 14 of the driver electronics housing 15. In some embodiments, the connection between the backup battery 40 and the driver electronics in the driver electronics level 14 of the driver electronics housing 15 is provided by a first side of backup power wiring 41 extending from the backup battery 40 through the electrical pathway opening in the junction box level 13. From the junction box level 13, a connection is made which extends within the interior of the driver electronics housing 15 to the driver electronics at the driver electronics level 14. The first side of the backup power wiring portion 41 of the backup battery 40 to the driver circuitry of the luminaire 100, so that when the primary power line 30 fails to power the light engine of the luminaire 100, suitable power for energizing the light emitting diodes (LEDs) of the light engine is provided by the backup battery 40. In this embodiment, a second side of the backup power wiring 42 extends from the battery backup 40 back to the junction box level 13 to hook up with the driver electronics in a way that provides that the backup battery 40 can power the light engine in the light engine housing 10 in the event that the primary power provided by the main power line 30 goes out.

The units including the backup battery 40 may also contain their own driver, not just a battery that regulates the current delivered to the light engine. The term "battery" can denote a structure, e.g., container, consisting of one or more cells, in which chemical energy is converted into electricity and used as a source of power. In some embodiments, the battery backup 40 may be a lithium iron phosphate ($LiFePO_4$) composition type battery. Lithium Iron Phosphate ($LiFePO_4$, LFE) is a kind of Li-Ion rechargeable battery for high power applications. LFP cells feature with high discharging current, non-explosive, long cycle life (>2000@0.2 C rate, IEC Standard), but its energy density is lower than normal Li-Ion cell (Li—Co) (higher NiMH cell). In other embodiments, the composition of the backup battery 40 may be Lithium-Manganese Oxide Battery, Lithium-Nickel Manganese Cobalt Oxide Battery, Lithium-Titanite Battery, Lithium-Cobalt Oxide Battery or combinations thereof. It is not required that the battery composition be a lithium containing composition. For example, the battery composition may be composed of a nickel cadmium (NiCd) composition, a nickel metal hydride (NiMH) composition, combinations thereof or other like compositions. In one example, the backup battery 40 has a type that is $LiFePO_4$ with 9.6 VDC.

The backup battery 40 may have an output current ranging from 100 mA to 1050 mA. The backup battery 40 may have an output voltage ranging from 11V to 56V. The backup battery 40 may have an output power equal to 25 W MAX. The backup battery 40 can have an input voltage of 90-305 VAC 50/60 Hz. The input current of the backup battery 40 can be 150 mA MAX. The recharge power can be 8 W MAX. It is noted that the aforementioned performance characteristics for the backup battery 40 are provided for illustrative purposes only, and are not intended to limit the disclosure to only these examples.

FIG. 14 also depicts one embodiment of junction box level 13 in electrical communication, e.g., across test wiring 46, to a test switch 55.

Figure 15:
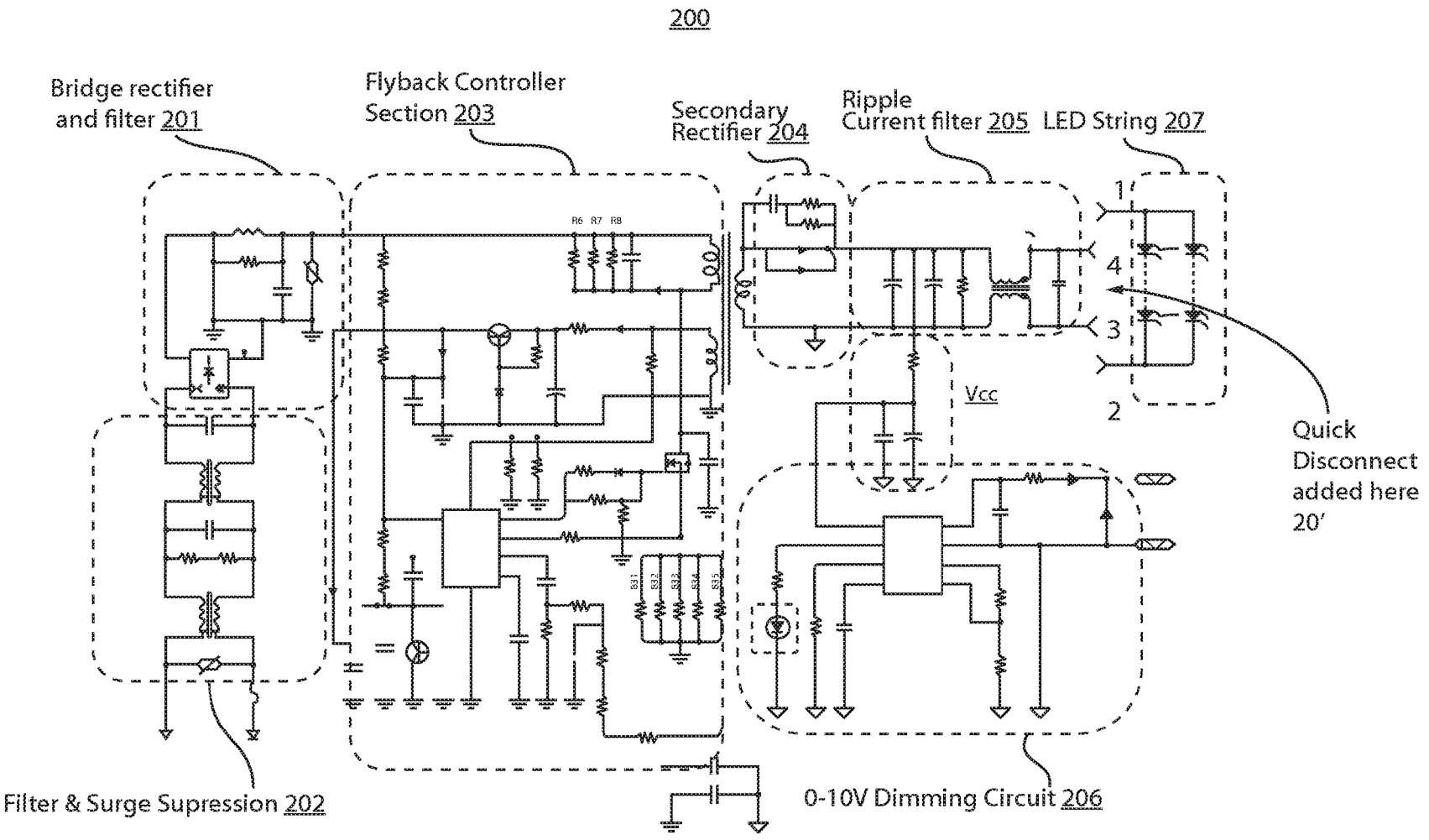
FIG. 15 is a circuit diagram for the electronics package of one embodiment of the downlight designs that is depicted in FIGS. 1-14.

FIG. 15 is a circuit diagram illustrating the electrical connectivity of the reversible driver to light source connector 20 for electrically connecting the light engine housing 10 containing the light emitting diode (LED) light source and the driver electronics housing 15, 15*a* including the driver electronics. In some embodiments, the electronics package 200 for the downlight may include: an EMI filter and surge protection circuit 202, bridge rectifier and filter circuit 201, flyback controller circuit 203, secondary rectifier circuit 204, ripple current filter circuit 205, 0V-10V dimming circuit 206, and LED strings 207. FIG. 15 illustrates that the reversible driver to light source connector 20 is present between the ripple current filter circuit 205 and the LED strings 207 at the interface identified by reference number 20'.

The EMI filter and surge protection 202 portion of the electronics package 200 includes an EMI filter to filter the high frequency noise generated by the flyback converter from entering the mains input terminals of line and neutral. The surge protector protects the luminaire from the surge caused by events such as lightning and disturbances on the mains grid. The surge protector absorbs the energy and limits the peak voltage to a safe level.

The bridge rectifier and filter circuit 201 portion of the electronics package 200 includes a bridge rectifier that rectifies the AC input voltage into a pulsating DC voltage. The filter filters the high frequency noise.

The flyback controller section 203 of the electronics package 200 contains the flyback transformer, switch, flyback controller, starting resistor, secondary rectifier and ripple current filter. This section of the electronics package 200 generates the required voltage and current as per the need of the LED strings 207. This section also provides the necessary isolation between the input and output.

The 0 to 10V dimming circuit 206 is the section accepts the input from the 0 to 10V dimmer and generates corresponding signal for the Secondary Current Sensing and Dimming. This enables the change of output current from power supply going into LEDs to be controlled by the external 0 to 10V dimmer. The 0-10V dimming circuit 206 is in electric communication with a 0-10V dimming wall switch. The 0-10V dimming circuit 206 is in electrical communication with the LEDs 207. The 0-10V dimming circuit 206 may be referred to as a 0-10V dimmable LED driver. In lighting control applications, "0-10" describes the use of an analog controller to adjust the voltage in a 2-wire (+10 VDC and Common) bus connecting the controller to one or more LED drivers equipped with a 0-10 VDC dimming input. A 0-10V dimmable LED driver includes a power supply circuit that produces approximately 10 VDC for the signal wires and sources an amount of current in order to maintain that voltage. The controlled lighting should scale its output so that at 10 V, the controlled light should be at 100% of its potential output, and at 0 V it should at the lowest possible dimming level.

A 0-10V LED dimmable driver designs with a control chip. The 0-10V voltage changes, the power supply output current will change. For example, when the 0-10V dimming signal modulates to 0V, the output current will be 0, the brightness of the light will be off; when the 0-10V dimming modulates to maximum 10V, the output current will reach 100% power output, the brightness will be 100%. In some embodiments, voltage of 1 volt to 9 volts is a range of dimming from with 1 volt being the minimum lighting. The light is off with 0V.

The LED string 207 portion of the electronics package 200 includes the circuitry to the number of LEDs, and the number of LED strings. The LED type, e.g., color temperature, can be chosen based on the requirement for the light output characteristics. These LED strings are driven by the voltage and current generated by the flyback converter and they generate the required optical characteristics.

Referring to FIG. 15, in some embodiments, the driver may be a single-channel or multi-channel electronic driver configured to drive the solid state light emitters, e.g., LEDs, utilizing pulse-width modulation (PWM) dimming or any other suitable standard, custom, or proprietary driving techniques. As further shown in FIG. 15, the driver may include a controller.

In another aspect, a lighting method is provided, as depicted in FIGS. 16-21. The methods described herein employ a lighting structure that includes a driver electronics housing 15, 15*a* and a physically separate light engine housing 10, wherein electrical connection between the driver electronics housing 15, 15*a* and the light engine housing 10 is through reversible driver to light source connector 20. The driver electronics housing 15 includes a main power connection. The connection of the main power line 30 to the main power connection can be tested through a test module 60 that is engaged to the terminal 20*a* (first terminal 20*a*) of the reversible driver to light source connector 20 that is in electrical communication with the driver electronics of the driver electronics housing 15, 15*a*.

Figure 16:
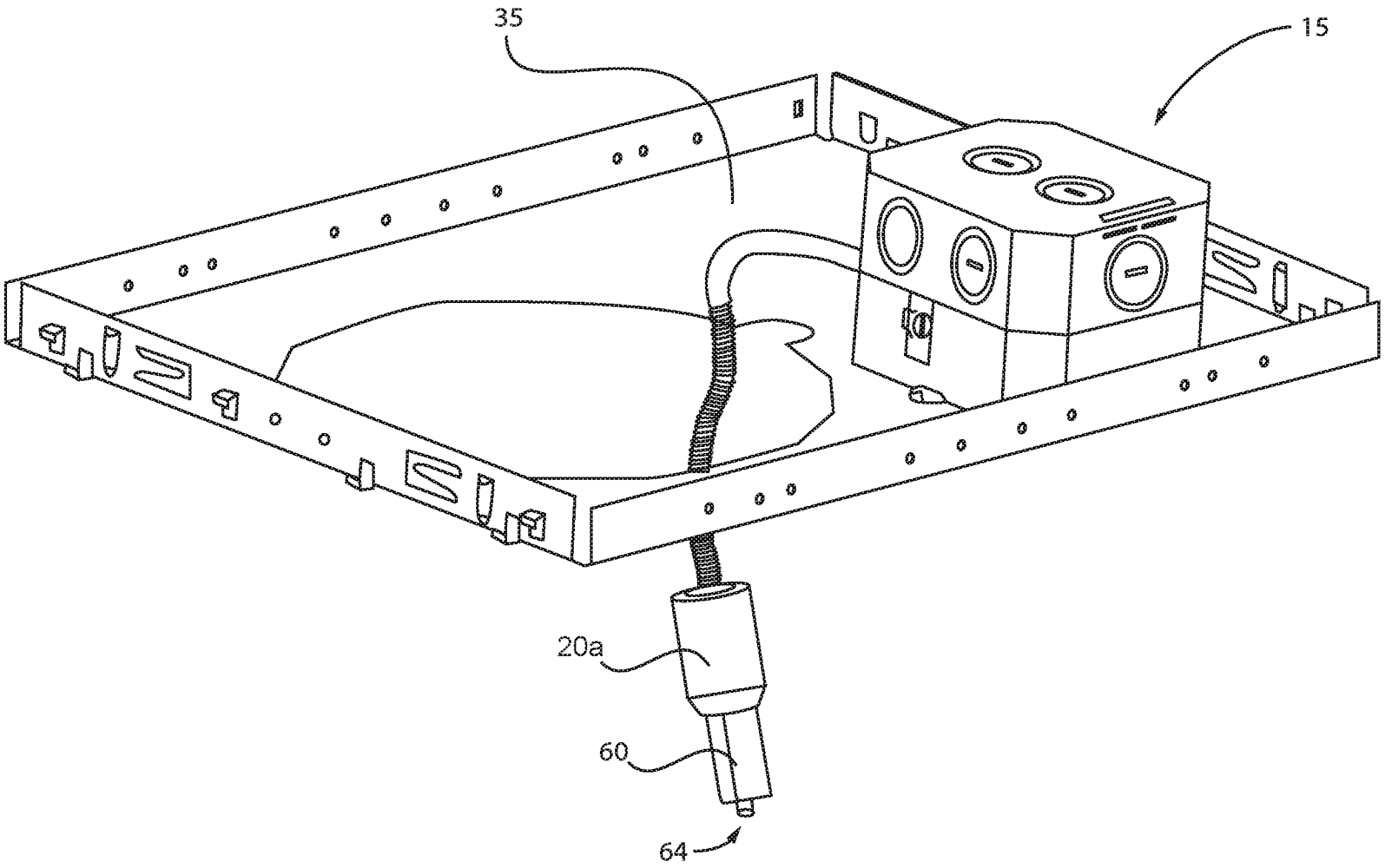
FIG. 16 is a perspective view of a second housing including the driver electronics mounted in a lighting fixture position, in which the first housing has been removed by disconnecting the reversible driver to light source connector, and a testing module has been connected into electrical connection with the second housing, in accordance with one embodiment of the present disclosure.

Referring to FIG. 16, in some embodiments, the method may begin with connecting a housing, e.g., driver electronics housing 15, 15*a*, including driver electronics and a junction box to a main power source, e.g., a main power line 30. The main power source is connected to a main power connector in a junction box compartment of the driver electronics housing 15, 15*a*.

In some embodiments, as depicted in FIG. 16, the driver electronics housing 15 includes a two level housing having a vertical stack of a driver electronics level 14 and junction box level 13. The junction box level 13 is connected to the main power source. More specifically, the main power line 30, e.g., the main power source, is connected to a main power connector in the junction box level 13 of the two level housing. In this example, the driver electronics are present in a driver electronics level 14, and the driver electronics are in electrical communication with the first terminal 20*a*. The driver electronics housing 15 including the two level housing having the vertical stack of the driver electronics level 14 and junction box level 13 has been described above with reference to FIGS. 1-5, 10, 12 and 14. It is noted that the driver electronics housing 15*a* including two laterally disposed compartments 13, 16 for electrical connections on opposing sides of a centrally positioned compartment 14 including driver electronics that has been described above with reference to FIGS. 6-9 can be substituted for the driver electronics housing 15 depicted in FIG. 16. The driver electronics housing 15*a* including two laterally disposed compartments 13, 16 for electrical connections on opposing sides of a centrally positioned compartment 14 is suitable for installation into a ceiling from the room side of the ceiling through a small diameter opening. The width W1 and geometry of the driver electronics housing 15*a* is dimensioned to allow for the driver electronics housing 15*a* to be passed through a small diameter opening, e.g., less than 5" in diameter, during the installation. This provides that the light installation method is suitable for light assemblies including light engine housings 10 having a diameter on the order of 4 inches or less, and in some examples having a diameter on the order of 3 inches or less.

FIG. 16 illustrates the driver electronics housing 15, 15*a* being installed in a ceiling. In FIG. 16, the driver electronics housing 15, 15*a* is installed to a tray 35, in which the tray 35 is engaged to a ceiling panel 36. It is noted that this is only one embodiment of the present disclosure. The tray 35 may be omitted. For example, the method is equally applicable to the embodiments depicted in FIGS. 10 and 11, in which the tray is omitted, and the engagement of the light assembly is through the light engine housing 10 having clamps 9 for engaging the perimeter of the opening in the ceiling panel 36.

In some embodiments, FIG. 16 illustrates the light assembly including the driver electronics housing 15, 15*a* remaining in the ceiling after the light engine housing 10 has been disconnected from the driver electronics housing 15, 15*a* and removed. This could be a step of a retrofit application. Separating the driver electronics housing 15, 15*a* from the light engine housing 10 allows for the main power connection, e.g., through main power line 30, to be made to the driver electronics in the driver electronics housing 15, 15*a* without the light engine housing 10 including the light emitting diode (LED) light engine being present to possibly obstruct the installer from accessing the power lines for connection to the main power connection in the driver electronics housing 10.

Figure 17:
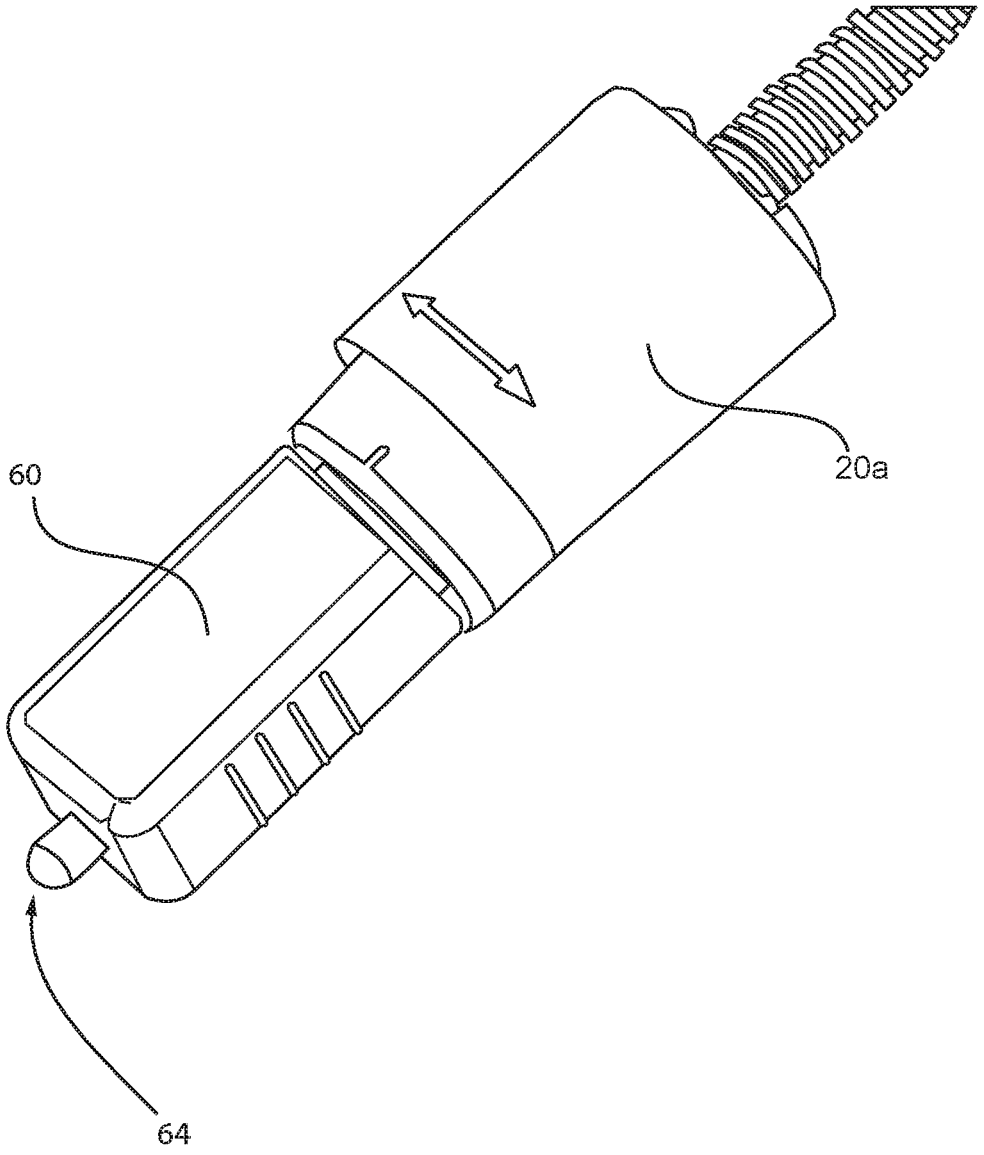
FIG. 17 is a perspective view of a testing module connected to the portion of the reversible driver to light source connector engaged to the second housing including the driver electronics.

Thereafter, the sufficiency of that main power connection may be tested through the first terminal 20*a* that is engaged to the driver electronics in the driver electronics housing 15, 15*a*. More specifically, a test module 60 can be connected to the first terminal 20*a* that provides a measurement of the electrical connection of the main power line 30 to the driver electronics housing 15, 15*a*. The test module 60 is depicted in FIG. 16 from the perspective of ceiling down. FIG. 17 is a magnified view of the test module 60 being engaged to the first terminal 20*a*. In some embodiments, the test module 60 includes a test light 64. In this example, the test light 64 is illuminated when the test module 50 is engaged to the first terminal 20*a*, and the driver electronics housing 15 is adequately connected to the main power source. In this example, the test light 64 is not illuminated when the test module 60 is engaged to the first terminal 20*a* of the reversible driver to light source connector 20 and the driver electronics housing 15 is not adequately connected to the main power source.

The test light 64 may be a light emitting diode (LED).

Figure 18:
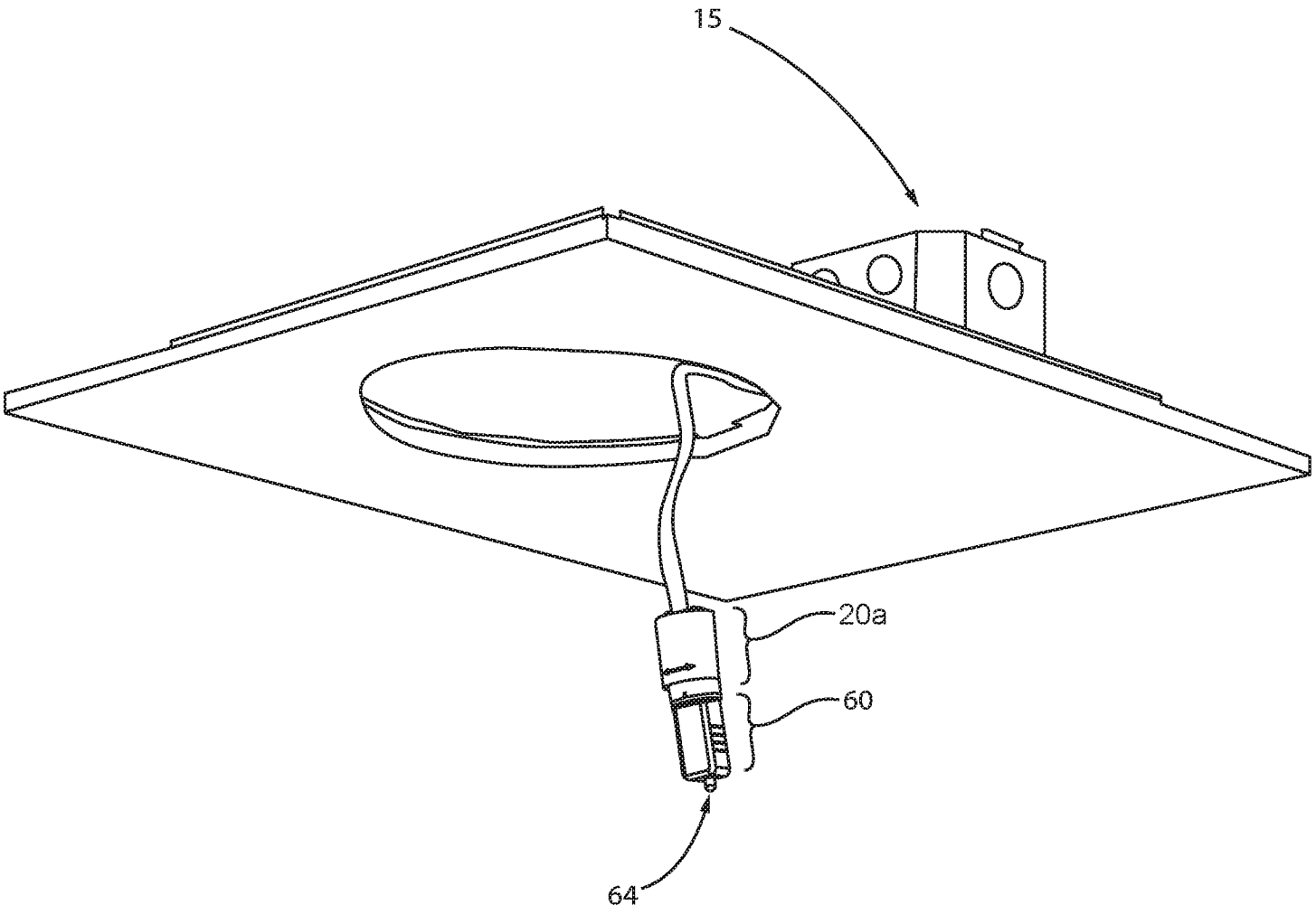
FIG. 18 is a perspective view of a testing module connected to the portion of the reversible driver to light source connector engaged to the second housing including the driver electronics, in which the second housing is mounted in the ceiling and the testing module is extending through the opening in the ceiling for engagement by the first housing including the light emitting diode (LED) light source.

Referring to FIGS. 16, 17 and 18, inspection can be visual when using the test module 60, while leaving the wiring, e.g., wiring to the first terminal 20*a* visually accessible. The test module 60 allows for a visual test of the main power connection without having to suspend the light engine housing 10 including the light engine/reflector from the ceiling while wired to the driver electronics housing 15, 15*a*. Prior to the methods and structures of the present disclosure, in some instances the ceiling is often left open for the wiring inspection. To verify functionality, and the power connection to the light fixture, in prior methods the whole reflector part of the downlight ends up dangling from the ceiling. For large sized downlights, that can be particularly dangerous. First, a large sized downlight can be a bulky and heavy structure, and it may potentially damage the wiring due to the stress on the wiring from the weight of the downlight. In some instances, the weight of the downlight can break the wire, wherein the downlight can then crash down to the floor. The reversible driver to light source connector 20 eliminates that situation, by separating the first engine housing 10 including the light engine/reflector from the driver electronics housing 15, 15*a* including the main power connections. As depicted in FIGS. 16 and 18, the test module 60 is clearly visible on the room side of the ceiling for testing the power connection to the driver electronics that are contained in the driver electronics housing 15*a*, 15 that is mounted in the ceiling, without the light engine housing 10 being suspended from the ceiling by wiring, such as the wiring connecting the light source to the driver electronics.

In the depicted embodiments, the signal provided by the testing module 60 is a visual signal that is provided by a test light 64 having a light emitting diode. However, the test light 64 is not limited to only this type of bulb. Additionally, the test module 60 may not necessarily have a test light 64, as other signal structures are possible for indicating a positive test with the test module 60. A positive test could be an indication that the main power connection wiring 31 is properly connected to the driver electronics. A positive test could be the test light 64 lighting up. In other embodiments, instead of the test light, the test module 60 could emit an audible sound. In yet other embodiments, the test light 64 of the test module 60 may be substituted with a signal sending transmitter. The signal sending transmitter may send a signal of a good main power connection or a bad main power connection to an interface through which an installer is testing the installation, e.g., an application being run on a mobile computing device being used by the installer.

Figure 19A:
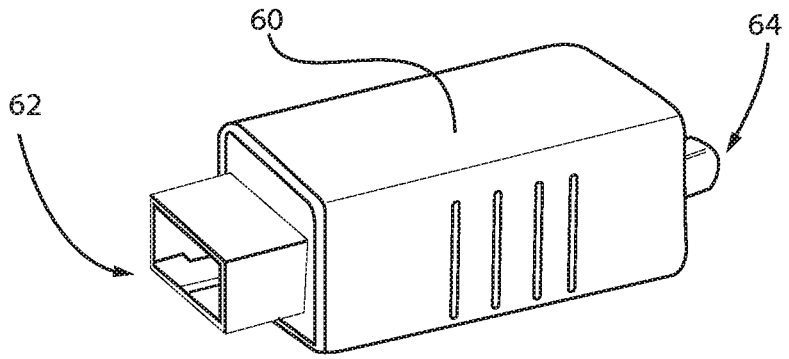
FIGS. 19A and 19B are perspective views of the testing module.
Figure 19B:
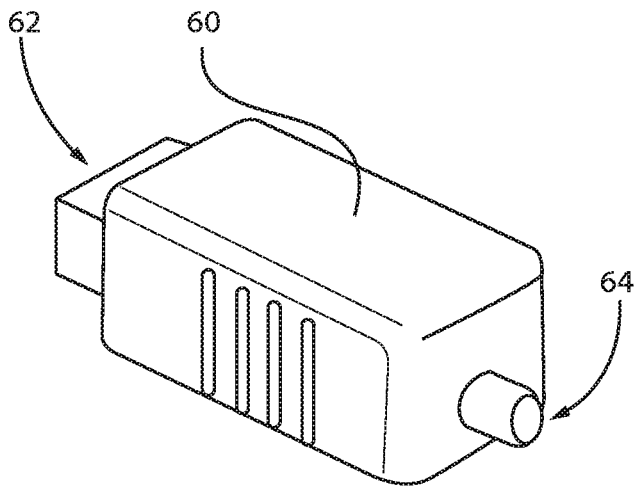
Figure 19C:
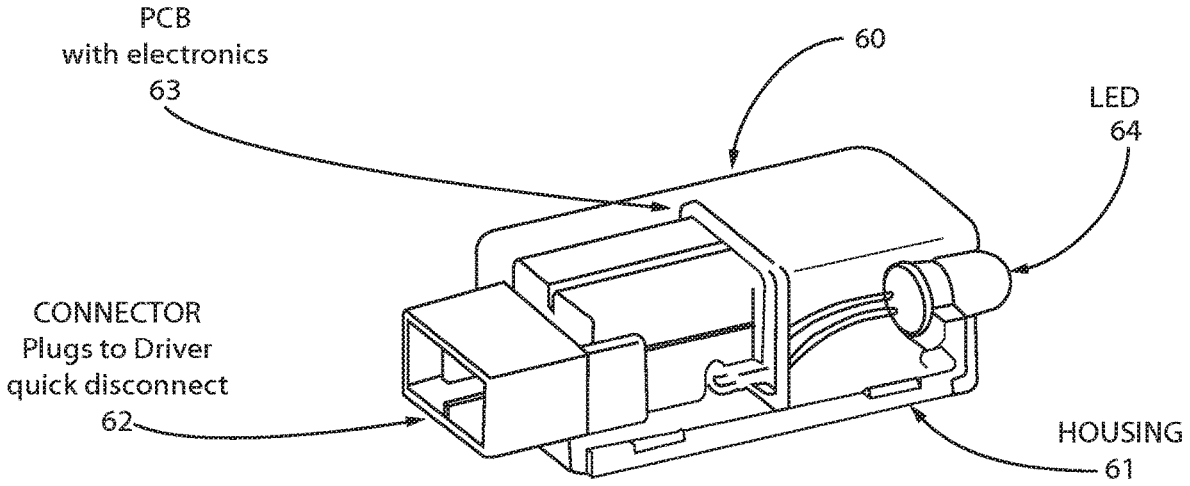
FIG. 19C is a sectioned view of the testing module illustrating the internal components of the testing module, in accordance with one embodiment of the present disclosure.
Figure 20:
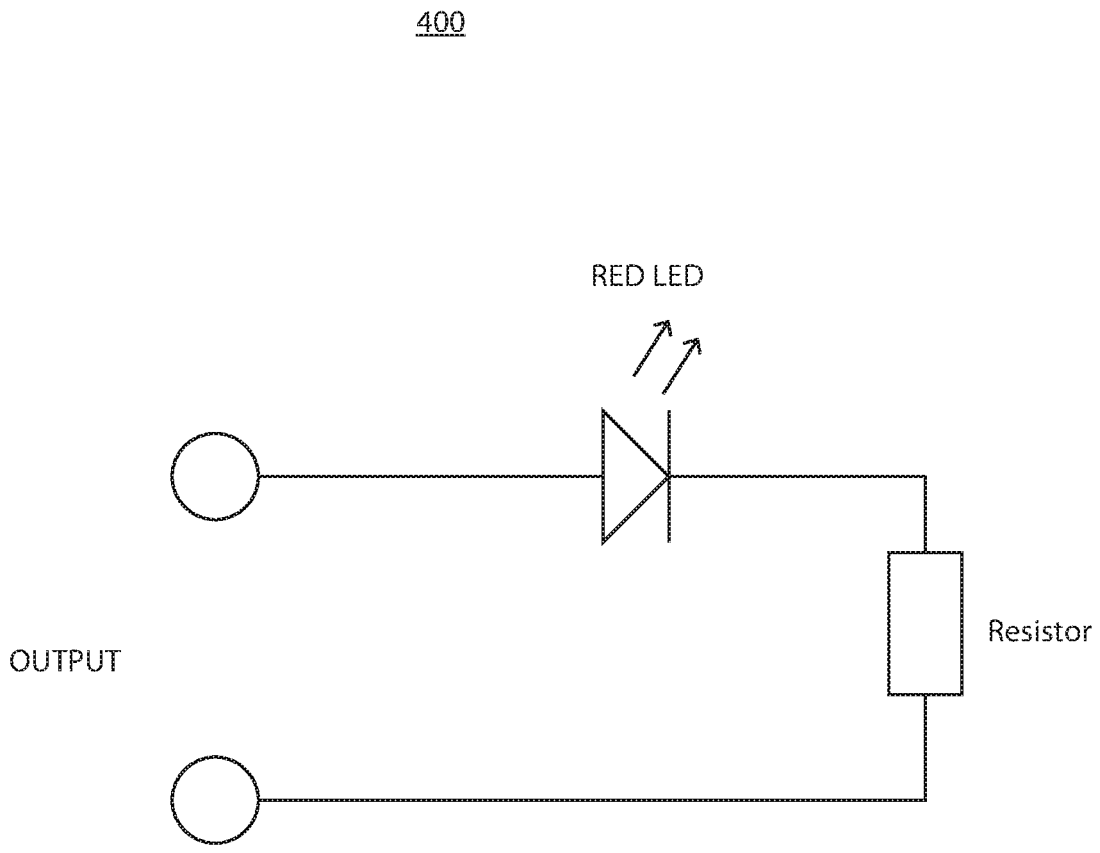
FIG. 20 is a circuit diagram for the electronics package of one embodiment of the downlight designs that is depicted in FIGS. 16-19C.

FIGS. 19A-19C depict one embodiment of the test module 60 disconnected from the first terminal 20*a*. The test module 60 includes a connector 62 through which the test module 60 is connected to the first terminal module 20*a* at a first end of the housing 61 of the test module 60, and a test light 64 present at an opposing second end of the housing 61. Contained within the housing 61 of the test module 60 is a printed circuit board (PCB) 63. In some embodiments, the printed circuit board (PCB) 63 may include the test circuit 400 that is depicted in FIG. 20. The test circuit may include a driver output terminal and a ground terminal at the connector 62 of the test module. Positioned between the driver output terminals is a resistor and the test light 64, which are connected in series. It is noted that this is only one example of the circuit that can be present on the printed circuit board (PCB) 63, and that other embodiments have also been contemplated. For example, the test circuit is such that the output of the driver is converted to match the input requirements of the indicator light emitting diode (LED), such as voltage and current limits.

Figure 21:
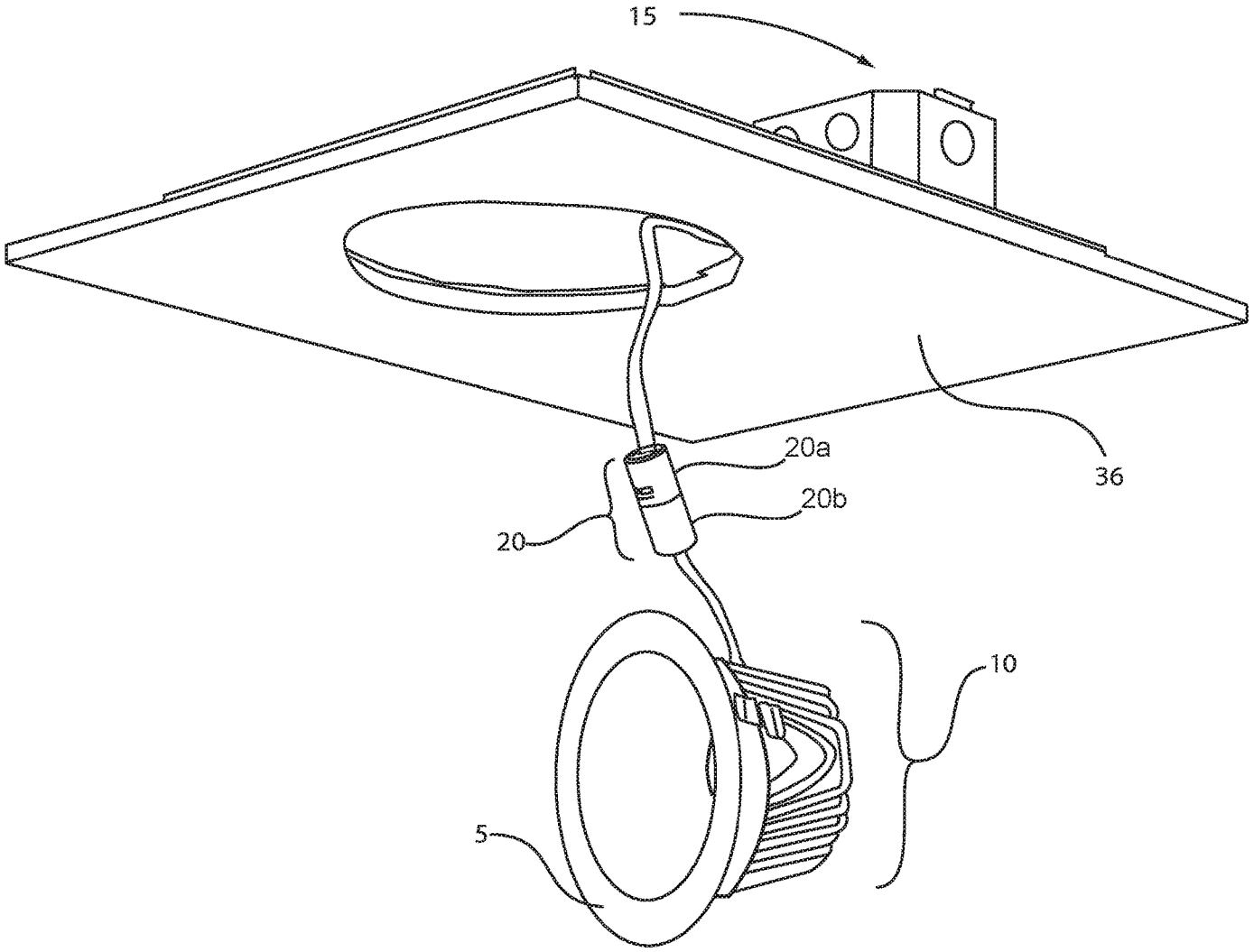
FIG. 21 is a perspective view of the power testing module being swapped with a terminal to the first housing including the light emitting diode (LED) light source.

FIG. 21 depicts removing the test module 60, e.g., after the test module 60 has signaled a proper main power connection, e.g., connection of the main power line 30 to the driver electronics housing 15, 15*a*, and replacing the test module 60 with a second terminal 20*b* of the light engine housing 10 including the light engine/reflector. In some embodiments, the second terminal 20*b* of the light engine housing 10 is connected to first second terminal 20*a* by twist connection when the first and second terminals 20*a*, 20*b* are mating twist connectors.

In some embodiments, before the light engine housing 10 is electrically connected to the driver electronics housing 15, 15*a*, the method may further include selecting a light characteristic to be projected by a light source, e.g., light emitting diode (LED) light engine, that is present in the light engine housing 10 having a recessed downlight can geometry. Selecting the light characteristic includes setting a switch 12 to the light characteristic. The switch 12 is present on a driver electronics housing 15 containing the driver electronics and having a main power connection, e.g., the main power connection is for electrical contact to the main power line 30.

The light engine housing 10 and the driver electronics housing 15, 15*a* are reversibly connected by a reversible driver to light source connector 20. Separating the light housing 10 and driver electronics housing 15 allows for the driver electronics housing 15, 15*c* including the driver electronics to be installed in the ceiling separately from the first housing 10.

The first housing 10 may then be installed into the ceiling providing a finalized installation.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGs. It will be understood that the spatially relative terms are intended to encompass different orientations of the device in use or operation in addition to the orientation depicted in the FIGs.

Having described preferred embodiments of a downlight having quick connect driver assembly and test module it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A lighting test method comprising:

connecting a driver electronics housing to a main power source, the driver electronics housing including two laterally disposed compartments for electrical connections on opposing sides of a centrally positioned compartment including driver electronics, the driver electronics in communication with a switch for setting lighting characteristics present on an exterior of the driver electronics housing and the driver electronics in electrical communication with a first terminal extending to the exterior of the driver electronics housing, wherein a first compartment of the two laterally disposed compartments includes a main power connector for connection to the main power source;

connecting a power testing module to the first terminal to determine whether the main power source is correctly connected to the main power source; and replacing the power testing module with a second terminal of a light engine housing, the first and second terminal electrically connected to provide that the driver electronics are in electrical communication with a light engine within the light engine housing.

2. The method of claim 1, wherein the first terminal that is in electrical communication to driver electronics by wired connection extending through a second compartment of the two laterally disposed compartments for electrical connections.

3. The method of claim 2, wherein the second compartment of the two laterally disposed compartments for electrical connections includes a connection for dimming controls to the light source.

4. The method of claim 3, wherein the second compartment of the two laterally disposed compartments for electrical connections includes a connection for an auxiliary power source.

5. The method of claim 3, wherein the power testing module includes a light that illuminates to indicate a suitable connection to the main power source.

6. The method of claim 3, wherein the connecting the driver electronics housing to the main power source further comprises mounting the driver electronics housing to a tray bracket that is installed on an in ceiling side of a ceiling, and the first terminal extends through an opening in the ceiling that the light engine housing projects light through once installed to a room side of the ceiling, wherein said connecting the power testing module to the first terminal is conducted on the room side of the ceiling.

7. The method of claim 1, wherein the driver electronics housing is installed into a ceiling through a lighting hole having a diameter of 5 inches or less.

* * * * *